US008308100B2

(12) United States Patent
Yanagishita

(10) Patent No.: US 8,308,100 B2
(45) Date of Patent: Nov. 13, 2012

(54) RECORDING MEDIUM FEEDING DEVICE

(75) Inventor: Kenji Yanagishita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 176 days.

(21) Appl. No.: 12/881,938

(22) Filed: Sep. 14, 2010

(65) Prior Publication Data

US 2011/0062270 A1 Mar. 17, 2011

(30) Foreign Application Priority Data

Sep. 15, 2009 (JP) ..... 2009-213210

(51) Int. Cl.
*B65H 75/48* (2006.01)

(52) U.S. Cl. ..... 242/390.6; 242/390.9; 242/394

(58) Field of Classification Search ..... 242/390.2, 242/390.6, 390.9, 394
See application file for complete search history.

(56) References Cited

U.S. PATENT DOCUMENTS

| | | | | |
|---|---|---|---|---|
| 6,082,912 | A * | 7/2000 | Shimizu et al. | 400/120.01 |
| 6,183,060 | B1 * | 2/2001 | Tokuda | 347/33 |
| 7,959,367 | B2 * | 6/2011 | Mushimoto | 400/234 |
| 2006/0216097 | A1 * | 9/2006 | Ono | 400/225 |
| 2009/0047052 | A1 * | 2/2009 | Koyabu | 400/611 |
| 2011/0062271 | A1 * | 3/2011 | Yanagishita | 242/390.2 |

FOREIGN PATENT DOCUMENTS

| | | |
|---|---|---|
| JP | 06-099649 | 4/1994 |
| JP | 08-039880 | 2/1996 |
| JP | 2001-163495 | 6/2001 |
| JP | 2003-221148 | 8/2003 |
| JP | 2004-291395 | 10/2004 |
| JP | 2006-248683 | 9/2006 |

OTHER PUBLICATIONS

U.S. Appl. No. 12/882,345, May 8, 2012, Office Action.

* cited by examiner

*Primary Examiner* — Sang Kim
(74) *Attorney, Agent, or Firm* — Workman Nydegger

(57) ABSTRACT

A recording medium feeding device for feeding a recording medium, which is wound in the shape of a roll and is supported by a support shaft, by means of a feeding roller includes a motor for generating a driving force and a driving force transmission unit for rotating the support shaft by transmitting the driving force. A rotation resistance switching unit switches a limitation state of giving the support shaft a rotation resistance and an open state of not giving the rotation resistance. The rotation resistance switching unit includes a torque limiter which enters the limitation state by being rotatable around the rotation shaft and enters the open state by being opened. A torque limiter fixing unit connected with the driving force transmission unit fixes the torque limiter by rotating the motor in a first direction and opens the torque limiter by rotating the motor in a second, opposite direction.

11 Claims, 12 Drawing Sheets

RECORDING MEDIUM FEEDING DEVICE

The entire disclosure of Japanese Patent Application No. 2009-213210, filed Sep. 15, 2009 is expressly incorporated by reference herein.

BACKGROUND

1. Technical Field

The present invention relates to a recording medium feeding device.

2. Related Art

Hitherto, there has been known a paper feeding device for preventing a flexure of a roll paper generated by a rotation of a roll paper shaft due to inertia (for example, see JP-A-2001-163495). Furthermore, there are a method and a device for feeding a paper which gives an optimal back tension for each paper even when the kind of paper changes (for example, see JP-A-2004-291395).

However, the paper feeding device described in JP-A-2001-163495 includes a built-in type torque limiter at an end portion of a support shaft for supporting the roll paper. For that reason, when a rotational resistance, which is given to the support shaft, is changed, there is a need to exchange the support shaft or detach and exchange the torque limiter. Thus, there is a problem in that a suitable rotational resistance depending on a change in situation cannot be given with respect to the support shaft during feeding, winding, printing and the like of the recording medium.

Furthermore, the paper feeding device described in JP-A-2004-291395 is configured such that a plurality of torque limiters can be combined with and released each other by the operation of the lever to change a rotational resistance which is given to the support shaft for supporting the roll paper depending on the kinds of the roll papers. However, in this configuration, there is a problem in that it cannot correspond to a change in rotation resistance during other than printing, such as during feeding or winding of the recording medium. Furthermore, there is a problem in that the connection and the disconnection of the plurality of torque limiters need to be manually performed.

SUMMARY

Thus, an advantage of some aspects of the present invention is to provide a recording medium feeding device that can give a suitable rotation resistance depending on a change in situation with respect to a support shaft for supporting a recording medium, which can automate a switch of the rotation resistance to be given to the support shaft.

A recording medium feeding device according to an aspect of the invention is a recording medium feeding device for feeding a recording medium, which is wound in the shape of a roll and supported by a support shaft, by means of a feeding roller, which includes a motor for generating a driving force; a driving force transmission unit for rotating the support shaft by transmitting the driving force; and a rotation resistance switching unit which can switch a limitation state of giving the support shaft the rotation resistance and an open state of not giving the support shaft the rotation resistance, the rotation resistance switching unit including a torque limiter, which enters the limitation state by being provided and fixed so as to be rotatable around the rotation shaft and enters the open state by being opened; and a torque limiter fixing unit which is connected with the driving force transmission unit to fix the torque limiter by a rotation of the motor in a first direction and open the torque limiter by a rotation of the motor in a second direction opposite to the first direction.

With this configuration, when the motor rotates in the first direction, the torque limiter fixing unit fixes the torque limiter, so that the torque limiter enters the limitation state of giving the support shaft the rotation resistance. Furthermore, when the motor rotates in the second direction, the torque limiter fixing unit opens the torque limiter, so that the torque limiter enters the open state of not giving the support shaft the rotation resistance. That is, the rotation resistance switching unit can switch the limitation state and the open state by means of the switch of the rotation direction of the motor. Thus, according to an aspect of the invention, it is possible to give a suitable rotation resistance depending on the situations with respect to the support shaft for supporting the recording medium, which can automate the switch of the rotation resistance given to the support shaft.

Furthermore, in the recording medium feeding device according to an aspect of the invention, the torque limiter fixing unit includes a holder, which is provided so as to be movable in a direction parallel to a longitudinal direction of the rotation shaft and is provided to be able to fix the torque limiter by being fitted to the torque limiter; and a cam which is provided such that it can move on a support surface, which supports the holder and is sloped with respect to a plane perpendicular to the longitudinal direction of the rotation shaft, in a direction perpendicular to the longitudinal direction of the rotation shaft with respect to the holder.

With this configuration, when the support surface of the cam moves in a direction which intersects the longitudinal direction of the rotation shaft of the torque limiter with respect to the holder, the holder relatively moves on the support surface in that direction. Here, the support surface slopes with respect to the plane perpendicular to the longitudinal direction of the rotation shaft of the torque limiter. For this reason, when the holder relatively moves on the support surface in the direction intersecting the longitudinal direction of the torque limiter in a state of being supported by the support surface, the holder also moves in a direction parallel to the longitudinal direction of the rotation shaft of the torque limiter by the slope of the support surface. As a result, it is possible to approximate the holder and the torque limiter to each other to fit them into each other, or it is possible to separate them from each other to release the fitting.

Furthermore, in the recording medium feeding device of an aspect of the invention, the torque limiter fixing unit includes a sliding gear which is connected to the driving force transmission unit so as to be able to transmit the driving force and is provided so as to be rotatable around a rotation shaft parallel to the rotation shaft of the torque limiter. The cam is provided so as to be slidable with the sliding gear and is provided so as to be rotatable around the rotation shaft of the sliding gear.

With this configuration, when the sliding gear rotates, the cam slides with the sliding gear and is subjected to a frictional force in the rotation direction of the sliding gear. The cam hereby rotates in the rotation direction of the sliding gear around the rotation shaft of the sliding gear, so that the support surface provided on the cam moves in the rotation direction of the cam perpendicular to the rotation shaft of the sliding gear with respect to the holder. Herein, the rotation shaft of the sliding gear is parallel to the rotation shaft of the torque limiter. Thus, it is possible to move the support surface of the cam in the direction perpendicular to the longitudinal direction of the rotation shaft of the torque limiter with respect to the holder, thereby moving the holder in the direction parallel to the longitudinal direction of the rotation shaft of the torque limiter.

Moreover, in the recording medium feeding device of an aspect of the invention, a first support portion for supporting the holder in a state of being fitted to the torque limiter, and a second support portion for supporting the holder in a state of not being fitted to the torque limiter are provided on the support surface. The cam rotates so as to bring the first support portion into contact with the holder by the rotation in the first direction of the motor and bring the second support portion into contact with the holder by the rotation in the second direction of the motor.

With this configuration, when the motor rotates in the first direction, the cam rotates, the holder is supported by the first support portion of the cam and is fitted into the torque limiter. Furthermore, when the motor rotates in the second direction, the cam rotates, the holder is supported by the second support portion of the cam and is separated from the torque limiter, whereby the fitting is released.

Furthermore, in the recording medium feeding device of an aspect of the invention, the rotation resistance switching unit includes a torque limiter rotation unit which rotates so as to connect the torque limiter with the support shaft by the rotation in the first direction of the motor and release the connection of the torque limiter and the support shaft by the stopping of the motor or the rotation in the second direction of the motor.

With this configuration, after the motor rotates in the first direction to make the support shaft enter the limitation state, when the motor is stopped or rotated in the second direction, the torque limiter rotation unit can rotate to rapidly release the limitation state of the support shaft due to the torque limiter.

Furthermore, in the recording medium feeding device of an aspect of the invention, the driving force transmission unit is provided to transmit the driving force so as to rotate the feeding roller or the support shaft, the driving force transmission unit includes a driving force switching unit which can switch the transmission of the driving force to the feeding roller or the support shaft by the driving force transmission unit. The driving force switching unit is provided so as to transmit the driving force to the feeding roller via the driving force transmission unit by the rotation in the first direction of the motor and transmit the driving force to the support shaft via the driving force transmission unit by the rotation in the second direction of the motor.

With this configuration, when the motor rotates in the first direction, the driving force switching unit switches the transmission path of the driving force in the driving force transmission unit so that the driving force of the motor is transmitted to the feeding roller. As a result, the feeding roller rotates, so that the recording medium which is wound in the shape of a roll is fed by means of the feeding roller. Then, a tension acts in a transport direction of the recording medium, so that the support shaft for supporting the wound recording medium is rotated by the tension of the recording medium. At this time, the torque limiter of the rotation resistance switching unit is in the limitation state of giving the support shaft the rotation resistance by means of the rotation in the first direction of the motor. For that reason, it is possible to give the recording medium a suitable tension when the feeding roller feeds the recording medium.

Moreover, when the motor rotates in the second direction, the driving force switching unit switches the transmission path of the driving force in the driving force transmission unit so that the driving force of the motor is transmitted to the support shaft. As a result, the support shaft rotates and the recording medium is wound. At this time, the torque limiter of the rotation resistance switching unit is in the open state of not giving the support shaft the rotation resistance by means of the rotation in the second direction of the motor. For that reason, when the recording medium is wound by the support shaft, it is possible to rotate the support shaft without being influenced by the torque limiter.

Moreover, in the recording medium feeding device of an aspect of the invention, the driving force switching unit includes a rotation gear train having a center gear, which is connected to the driving force transmission unit, and a rotation gear which is connected to the center gear and is provided rotatably around the rotation shaft of the center gear. The rotation gear train rotates so as to release the connection of the rotation gear with the support shaft by means of the stopping or the rotation in the first direction of the motor and connect the rotation gear with the support shaft by means of the rotation in the second direction of the motor.

With this configuration, it is possible to release the connection of the rotation gear and the support shaft by the rotation in the first direction of the motor to cut the transmission of the driving force between the motor and the support shaft, thereby separating the driving of the motor from the rotation of the support shaft.

Furthermore, it is possible to connect the rotation gear with the support shaft by the rotation in the second direction of the motor to transmit the driving force, which has been transmitted from the driving force transmission unit to the center gear, to the support shaft via the rotation gear, thereby winding the recording medium by rotating the support shaft.

Moreover, in the recording medium feeding device of an aspect of the invention, the driving force switching unit includes an outer ring, which is engaged with a driving shaft gear provided on the driving shaft of the motor, a sun gear which is disposed on a rotation center of the outer ring and is connected so as to be integrally rotatable with the outer ring, and a planetary gear train having a plurality of planetary gears which is disposed around the sun gear inside the outer ring, is engaged with the sun gear and is connected so as to be integrally rotatable in the rotation direction of the sun gear. The planetary gear train is provided such that the plurality of planetary gears rotates by means of the rotation in the first direction of the motor, whereby a first planetary gear among the plurality of planetary gears is engaged with a feeding roller gear, which transmits the driving force to the feeding roller in the driving force transmission unit, and the plurality of planetary gears rotates by means of the rotation in the second direction of the motor, whereby the engagement of the first planetary gear and the feeding roller gear is released.

With this configuration, the driving force switching unit enables the rotation in the first direction of the motor to connect the first planetary gear with the feeding roller gear. As a result, it is possible to transmit the driving force of the motor to the feeding roller via the driving shaft gear, the outer ring, the sun gear, the first planetary gear, and the feeding roller gear.

Furthermore, it is possible to release the connection of the first planetary gear and the feeding roller gear by means of the rotation in the second direction of the motor. As a result, it is possible to cut the transmission of the driving force between the motor and the feeding roller to separate the driving of the motor from the rotation of the feeding roller.

Furthermore, the recording medium feeding device of an aspect of the invention includes a driven roller for pinching the recording medium together with the feeding roller, and a driven roller moving unit which is driven by the planetary gear train to move the driven roller to a pinch position near the feeding roller or to an open position separated from the feeding roller. The driven roller moving unit includes a driven roller holder for rotatably supporting the driven roller, an eccentric cam which moves the driven roller to the pinch position and the open position by moving the driven roller holder, an eccentric cam gear provided on a rotation shaft of the eccentric cam, and a complex gear in which a cam driving gear engaged with the eccentric cam gear is provided between a first partial gear and a second partial gear which are respectively provided at different angle ranges. The planetary gear train is provided such that the plurality of planetary gears rotates by the rotation in the first direction of the motor, whereby a second planetary gear among the plurality of planetary gears is engaged with the first partial gear, and the plurality of planetary gears rotates by the rotation in the second direction of the motor, whereby a third planetary gear among the plurality of planetary gears is engaged with the second partial gear.

With the configuration, the rotation in the first direction of the motor causes the second planetary gear and the first partial gear of the complex gear to engage with each other. Then, the driving force of the motor is transmitted from the second planetary gear to the complex gear, so that the complex gear rotates through the formed angle range of the first partial gear. Then the driving force is transmitted to the eccentric cam gear engaged with the cam driving gear of the complex gear, so that the eccentric cam gear rotates through a predetermined angle range corresponding to the angle range of the rotation of the complex gear. Then, the rotation shaft of the eccentric cam with the eccentric cam gear provided thereon rotates through a prescribed angle range, so that the eccentric cam rotates through a prescribed angle range. As a result, the driven roller holder moves, whereby the driven roller moves to the pinch position. At this time, the driving force of the motor is transmitted to the feeding roller via the driving force transmission unit by means of the driving force switching unit, so that the feeding roller rotates. For that reason, the recording medium can be fed by means of the rotation of the feeding roller in a state of being pinched between the driven roller and the feeding roller.

Furthermore, the rotation in the second direction of the motor causes the third planetary gear and the second partial gear of the complex gear to engage with each other. Then, the driving force of the motor is transmitted from the third planetary gear to the complex gear, so that the complex gear rotates through the formed angle range of the second partial gear. The rotation direction of the complex gear at this time is opposite to the rotation direction due to the rotation in the first direction of the motor. For this reason, due to the rotation of the complex gear, the rotation shaft of the eccentric cam and the eccentric cam rotate in a prescribed angle range in the opposite direction to the rotation direction caused by the rotation of the first direction of the motor. As a result, the driven roller holder moves, whereby the driven roller moves to the open position. At this time, the driving force switching unit cuts the transmission of the driving force of the motor to the feeding roller, whereby the driving force of the motor is transmitted to the support shaft via the driving force transmission unit. As a result, when the support shaft rotates to wind the recording medium, it is possible to wind the recording medium in the open state without pinching the recording medium by the driven roller and the feeding roller.

Furthermore, the recording medium feeding device of an aspect of the invention includes a fixing torque limiter gear train which is always connected to the support shaft to give the support shaft a rotation resistance. The rotation resistance given by the fixing torque limiter gear train is smaller than that given by the rotation resistance switching unit.

With this configuration, both of the rotation resistance switching unit and the fixing torque limiter gear train gives the support shaft the rotation resistance, or only the fixing torque limiter gear train can give the support shaft the rotation resistance. Thus, the support shaft can always give the rotation resistance, and the size of the rotation resistance given to the support shaft can be changed depending on the circumstances.

BRIEF DESCRIPTION OF THE DRAWINGS

The invention will be described with reference to the accompanying drawings, wherein like numbers reference like elements.

FIG. 5A is a perspective view in an open state, and FIG. 5B is a perspective view in a pinch state.

FIG. 7A is a perspective view in an open state, and FIG. 7B is a perspective view in pinch state.

DESCRIPTION OF EXEMPLARY EMBODIMENTS

Hereinafter, an embodiment of the invention will be described with reference to the drawings.

A paper feeding device of the present embodiment is a device for feeding a recording medium such as a recording paper wound in the shape of a roll to a printing device. Furthermore, the paper feeding device of the present embodiment can automatically switch a paper feeding state of feeding a recording paper, a winding state of performing the winding of the recording paper, a low tension printing state of giving a relatively small tension with respect to the recording paper during printing, a high tension printing state of giving a relatively large printing state with respect to the recording paper during printing and the like.

Figure 5A:
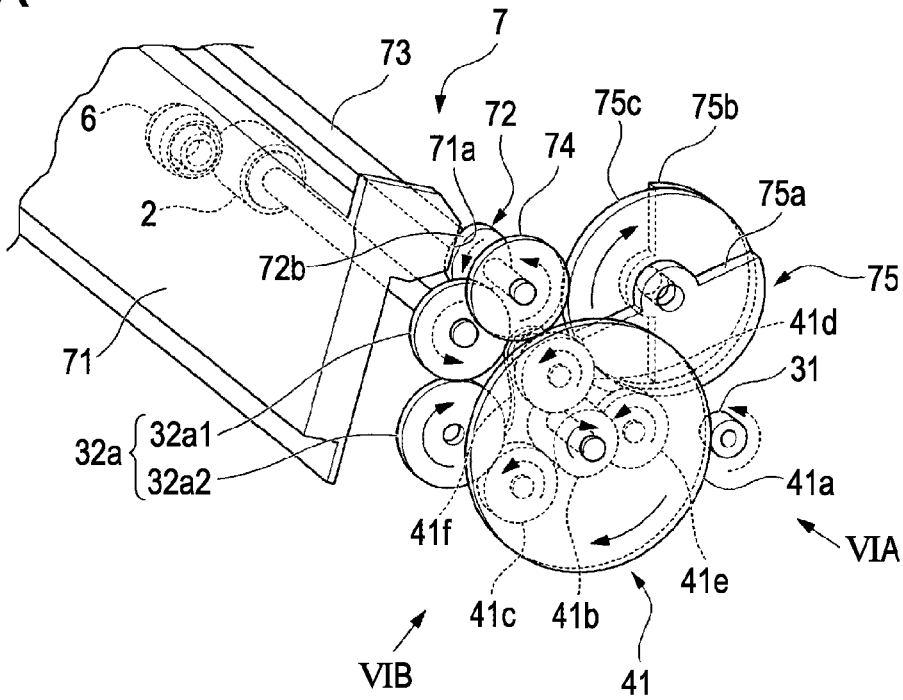
FIGS. 5A and 5B are perspective views in which a driven roller unit is seen from a front side.
Figure 5B:
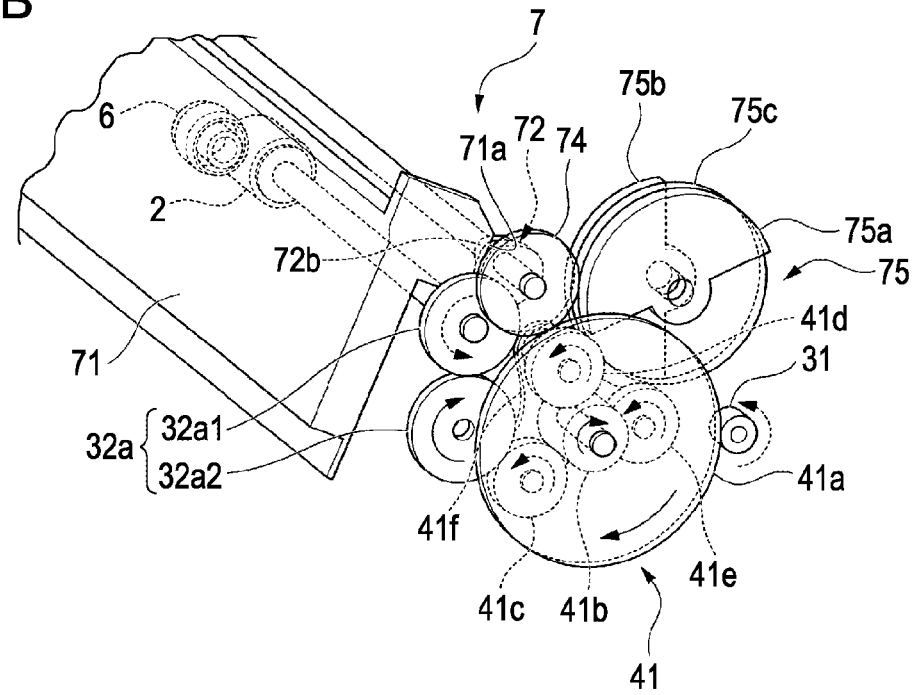
Figure 6A:
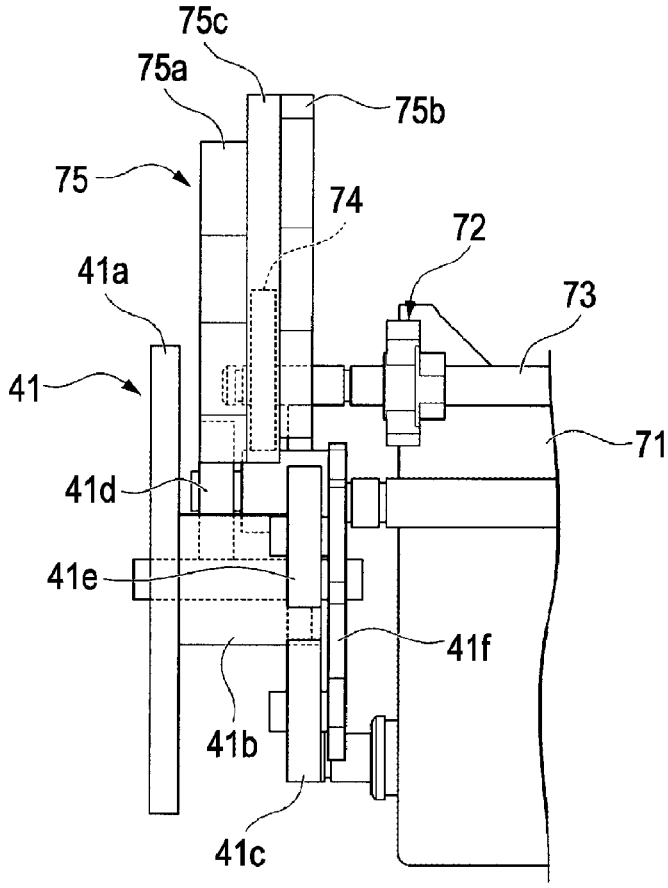
FIG. 6A is a view when seen from an arrow VIA direction in FIG. 5A.
Figure 6B:
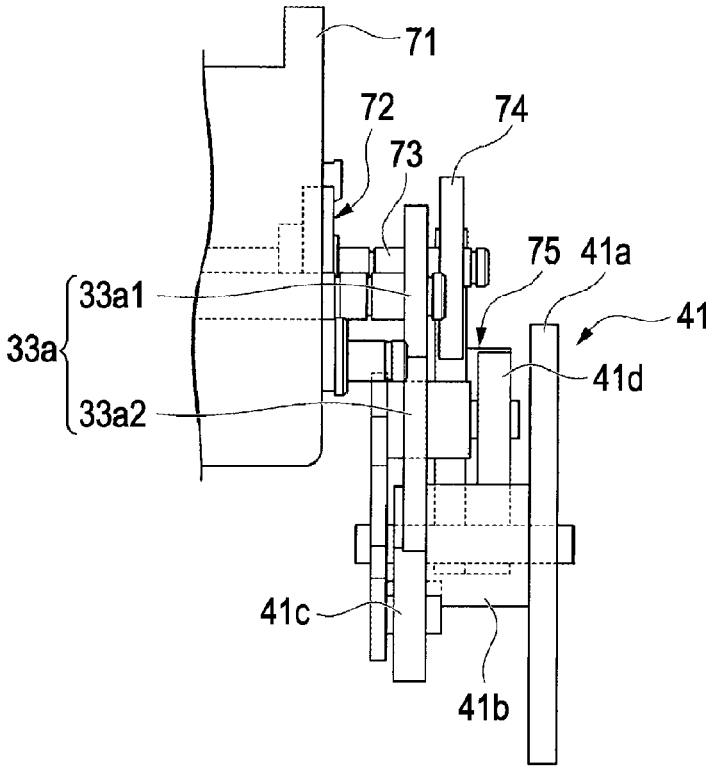
FIG. 6B is a view when seen from an arrow VIB direction in FIG. 5A.
Figure 7A:
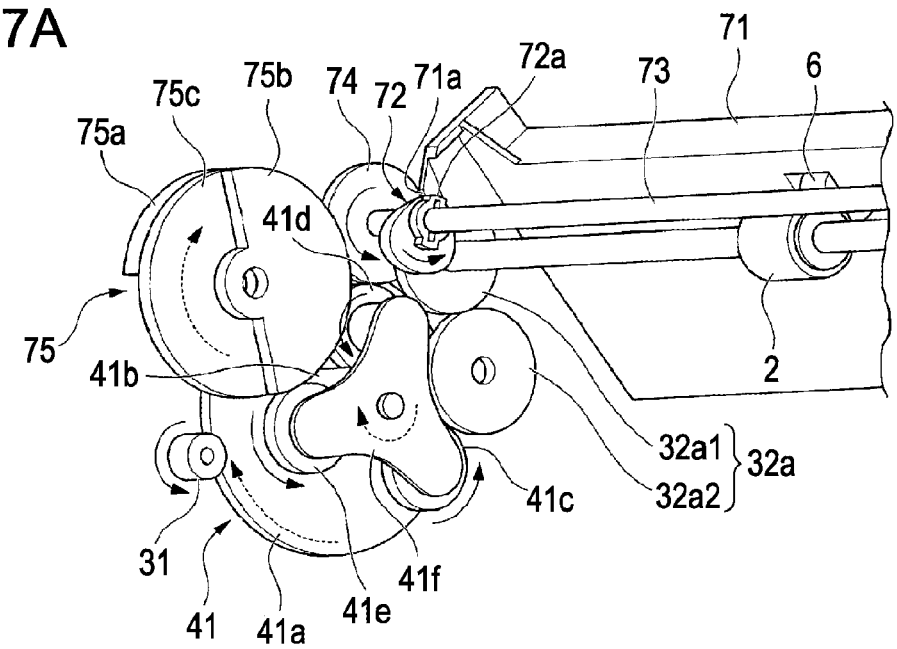
FIGS. 7A and 7B are perspective views in which a driven roller holder moving unit is seen from a bottom side.
Figure 7B:
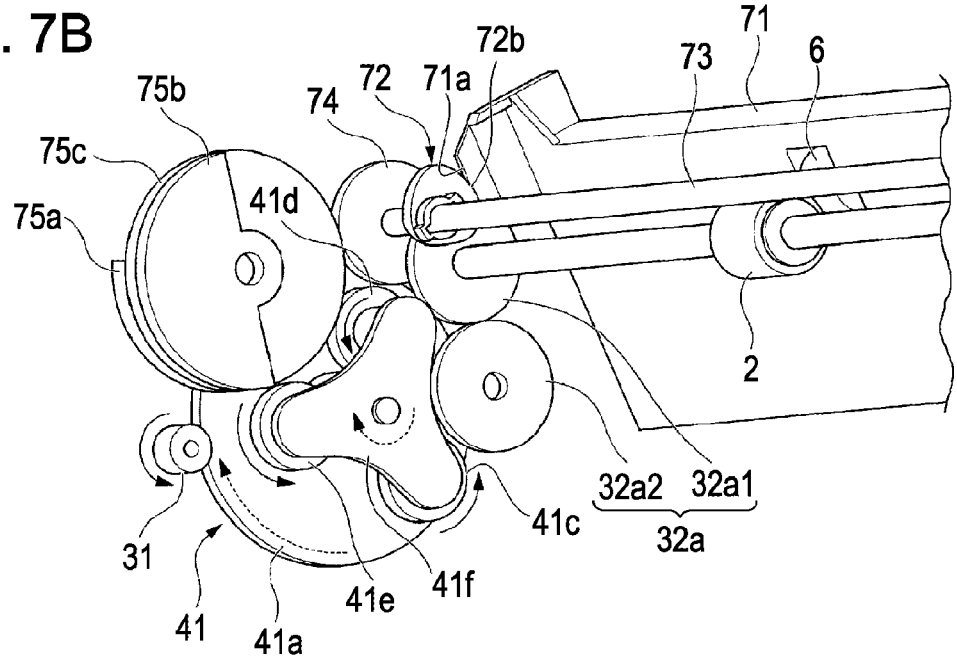
Figure 8:
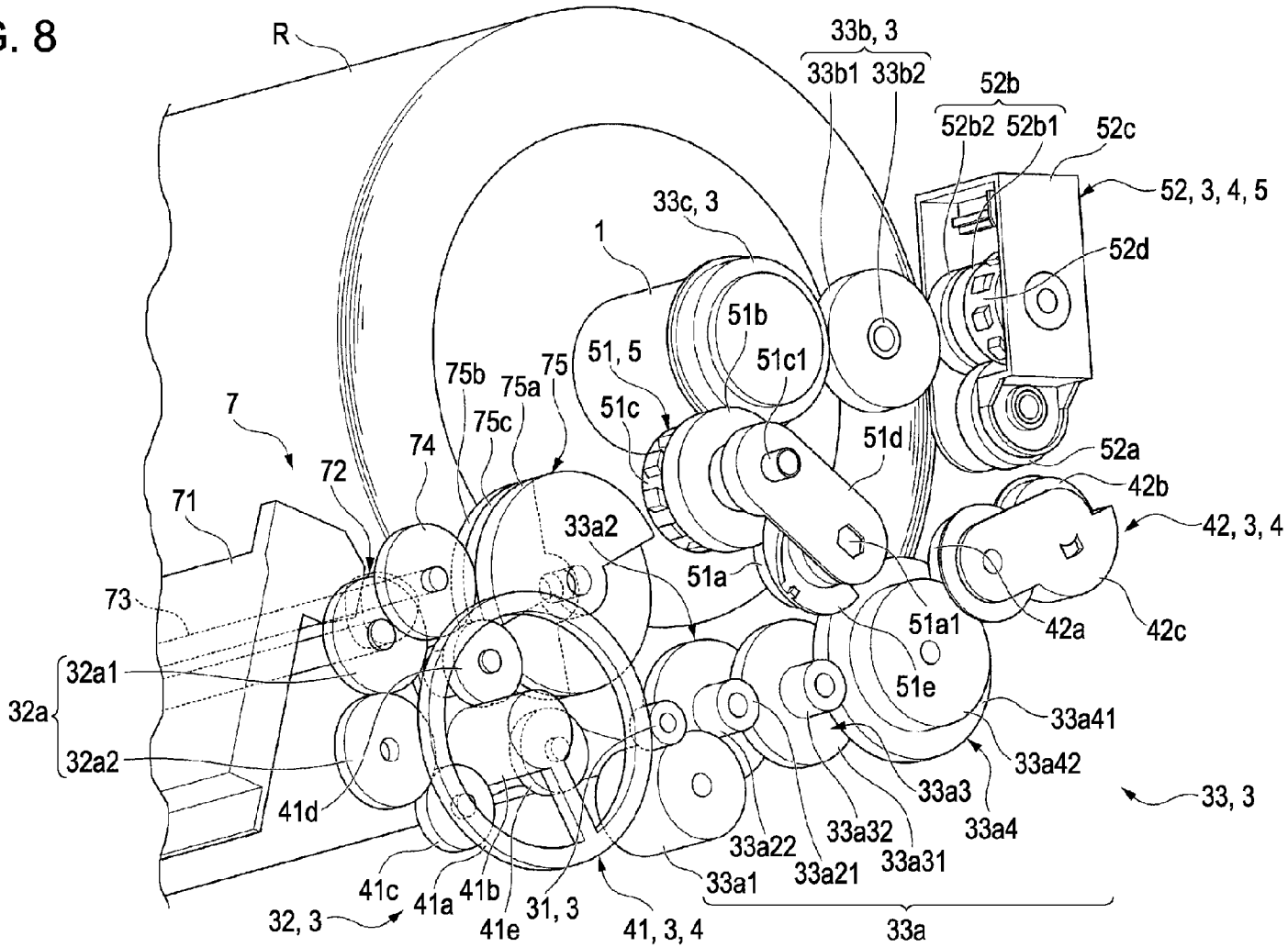
FIG. 8 is a perspective view of a driving force transmission unit, a driving force switching unit and a rotation resistance switching unit of the paper feeding device in FIG. 1.

FIGS. 1 to 4 are side views which respectively show a paper feeding state, a winding state, a low tension printing state and a high tension printing state of a paper feeding device PF of the present embodiment. FIG. 5 is an enlarged perspective view in which a driven roller moving unit 7 is seen from a front side, FIG. 5A is a perspective view in an open state, and FIG. 5B is a perspective view in a pinch state. FIG. 6A is a view when seen from an arrow VIA direction in FIG. 5A, and FIG. 6B is a view when seen from an arrow VIB direction in FIG. 5A. FIG. 7 is an enlarged perspective view in which the driven roller moving unit 7 is seen from a bottom side, FIG. 7A is a perspective view in a pinch state, and FIG. 7B is a perspective view in an open state. FIG. 8 is a perspective view showing a driving force transmission unit 3, a driving force switching unit 4 and a rotation resistance switching unit 5 of the paper feeding device PF in the paper feeding state.

As shown in FIGS. 1 to 8, the paper feeding device (a recording medium feeding device) PF includes a support shaft 1 for rotatably supporting a roll R of a recording paper (recording medium) P which is wound in the shape of a roll, and a feeding roller 2 for feeding the recording paper P, which has been pulled out from the roll R, to a printing device (not shown) disposed on the downstream side of the paper feeding device PF.

Furthermore, the paper feeding device PF includes a motor (not shown), and includes a driving force transmission unit 3 which transmits the driving force of the motor to the feeding roller 2 or the support shaft 1 to selectively rotate and drive one of them, and a driving force switching unit 4 which can switch the transmission of the driving force due to the driving force transmission unit 3 to the support shaft 1 and the feeding roller 2.

Furthermore, the paper feeding device PF includes a rotation resistance switching unit 5 that can switch a limitation state of giving the support shaft 1 a rotation resistance and an open state of not giving the support shaft 1 the rotation resistance.

Moreover, the paper feeding device PF includes a driven roller 6 which pinches the recording medium P together with the feeding roller 2 and rotates, and a driven roller moving unit 7 which moves the driven roller 6 to a pinch position near the feeding roller 2 or an open position separated from the feeding roller 2.

The driving force transmission unit 3 includes a driving shaft gear 31 fixed to the driving shaft of the motor, a feeding roller driving gear train 32 provided on the feeding roller 2 side of the driving shaft gear 31, and a support shaft driving gear train 33 provided on the support shaft 1 side of the driving shaft gear 31.

The rotation resistance switching unit 5 has a first torque limiter planetary gear train (a torque limiter rotating unit and a torque limiter fixing unit) 51, and a second torque limiter planetary gear train (a rotation gear) 52 included in the support shaft driving gear train 33.

The driving force switching unit 4 has a three consecutive planetary gear train (a planetary gear train) 41 included in the feeding roller driving gear train 32, a connection planetary gear train 42 included in the support shaft driving gear train 33, and a second torque limiter planetary gear train 52 included in the support shaft driving gear train 33 and the rotation resistance switching unit 5.

The driven roller moving unit 7 has a driven roller holder 71 for rotatably supporting the driven roller 6, an eccentric cam 72 for moving the driven roller holder 71, a rotation shaft 73 of the eccentric cam 72, an eccentric cam gear 74 provided on the rotation shaft 73, and a complex gear 75 connected with the eccentric cam gear 74.

In a paper feeding state shown in FIG. 1, the driving shaft gear 31 constituting the driving force transmission unit 3 rotates counterclockwise (hereinafter, called "CCW") when seen from the front by means of a forward rotation (a rotation in a first direction) of a motor (not shown). In addition, in a winding state shown in FIG. 2, the driving shaft gear 31 rotates clockwise (hereinafter, called "CW") when seen from the front by means of a backward rotation (a rotation in a second direction) of the motor (not shown). Moreover, in the low tension printing state shown in FIG. 3 and the high tension printing state shown in FIG. 4, the driving shaft gear 31 is in the stop state. In addition, in FIGS. 1 to 5 and 7, the CW rotations of the respective gears are shown by solid line arrows and the CCW rotations thereof are shown by dotted line arrows.

The feeding roller driving gear train 32 constituting the driving force transmission unit 3 has a three consecutive planetary gear train 41 connected to the driving shaft gear 31, and a feeding roller gear train 32*a* connected to the three consecutive planetary gear train 41. The feeding roller gear train 32*a* includes a first feeding roller gear (a feeding roller gear) 32*a*1, which is provided on the rotation shaft of the feeding roller 2, and a second feeding roller gear (a feeding roller gear) 32*a*2, which is connected to the first feeding roller gear train 32*a*1.

The support shaft driving gear train 33 constituting the driving force transmission unit 3 includes a driving force transmission gear train 33*a* connected to the driving shaft gear 31, a connection planetary gear train 42 connected to the driving force transmission gear train 33*a*, a second torque limiter planetary gear train 52 driven by the connection planetary gear train 42, a low resistance torque limiter gear train (a fixing torque limiter gear train) 33*b* driven by the second torque limiter planetary gear train 52, and a support shaft gear 33*c* provided on the support shaft 1.

The low resistance torque limiter gear train 33*b*, which constitutes the support shaft driving gear train 33 of the driving force transmission unit 3, includes a low resistance torque limiter gear 33*b*1, which is engaged and always connected with the support shaft gear 33*c*, and a low resistance torque limiter 33*b*2 which is combined integrally with the low resistance torque limiter gear 33*b*1. The low resistance torque limiter 33*b*2 is provided so as to give the rotation resistance of, for example, about 300 gf·cm when the low resistance torque limiter gear 33*b*1 performs the CW rotation and the CCW rotation. As the low resistance torque limiter 33*b*2, for example, a mechanical type of a hydraulic type can be used.

The first torque limiter planetary gear train 51 constituting the rotation resistance switching unit 5 includes a sun gear (a sliding gear) 51*a* connected to the driving force transmission gear train 33*a* of the driving force transmission unit 3, a planetary gear 51*b* which is not engaged and not connected with the sun gear 51*a*, a first high resistance torque limiter (a torque limiter) 51*c* which is provided integrally with the planetary gear 51*b*, a holder 51*d* which is provided so that it can be fitted into the first high resistance torque limiter 51*c*, and a cam 51*e* for supporting the holder 51*d*.

Figure 1:
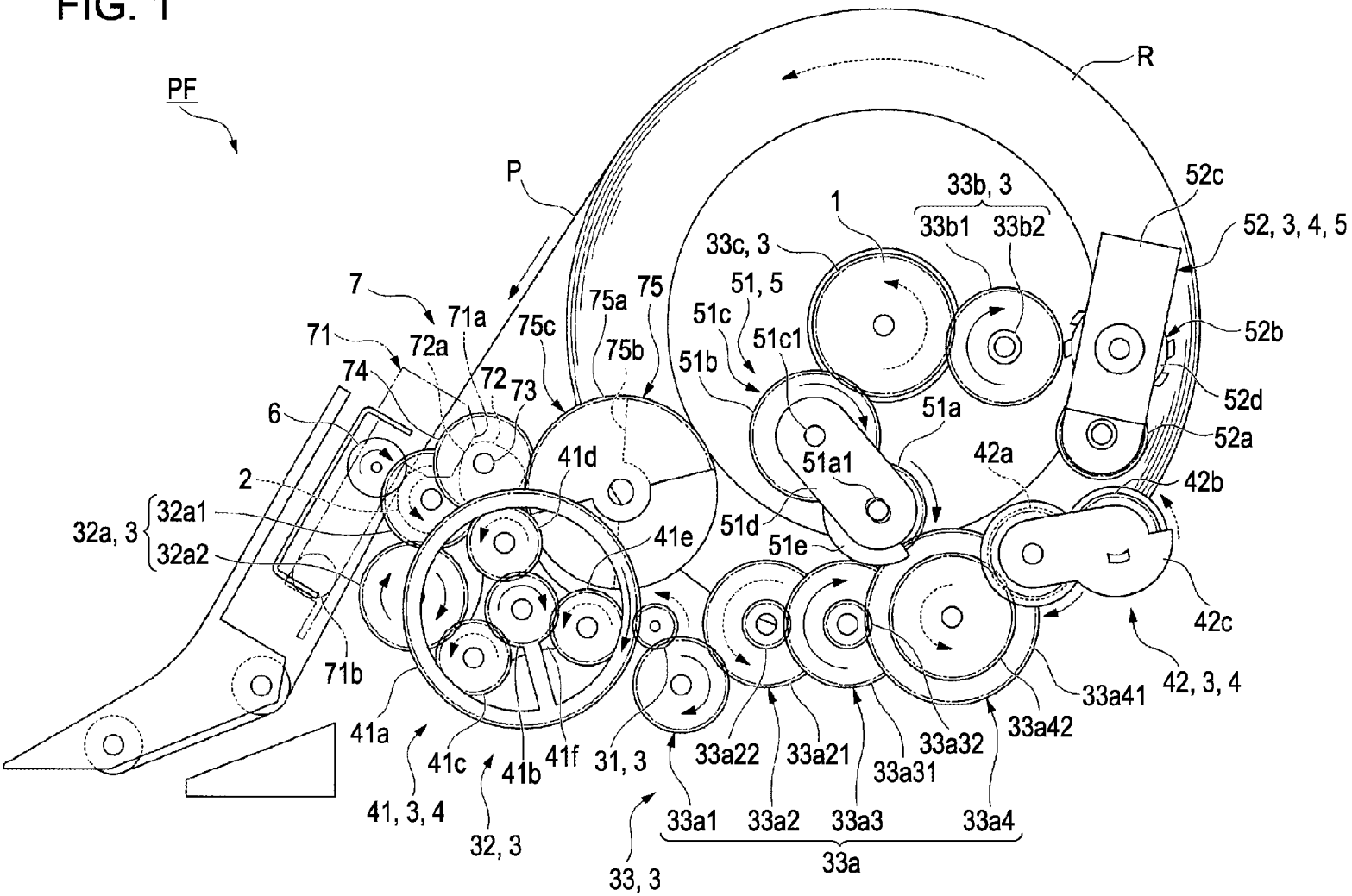
FIG. 1 is a side view in a paper feeding state of a paper feeding device relating to an embodiment of the invention.
Figure 9:
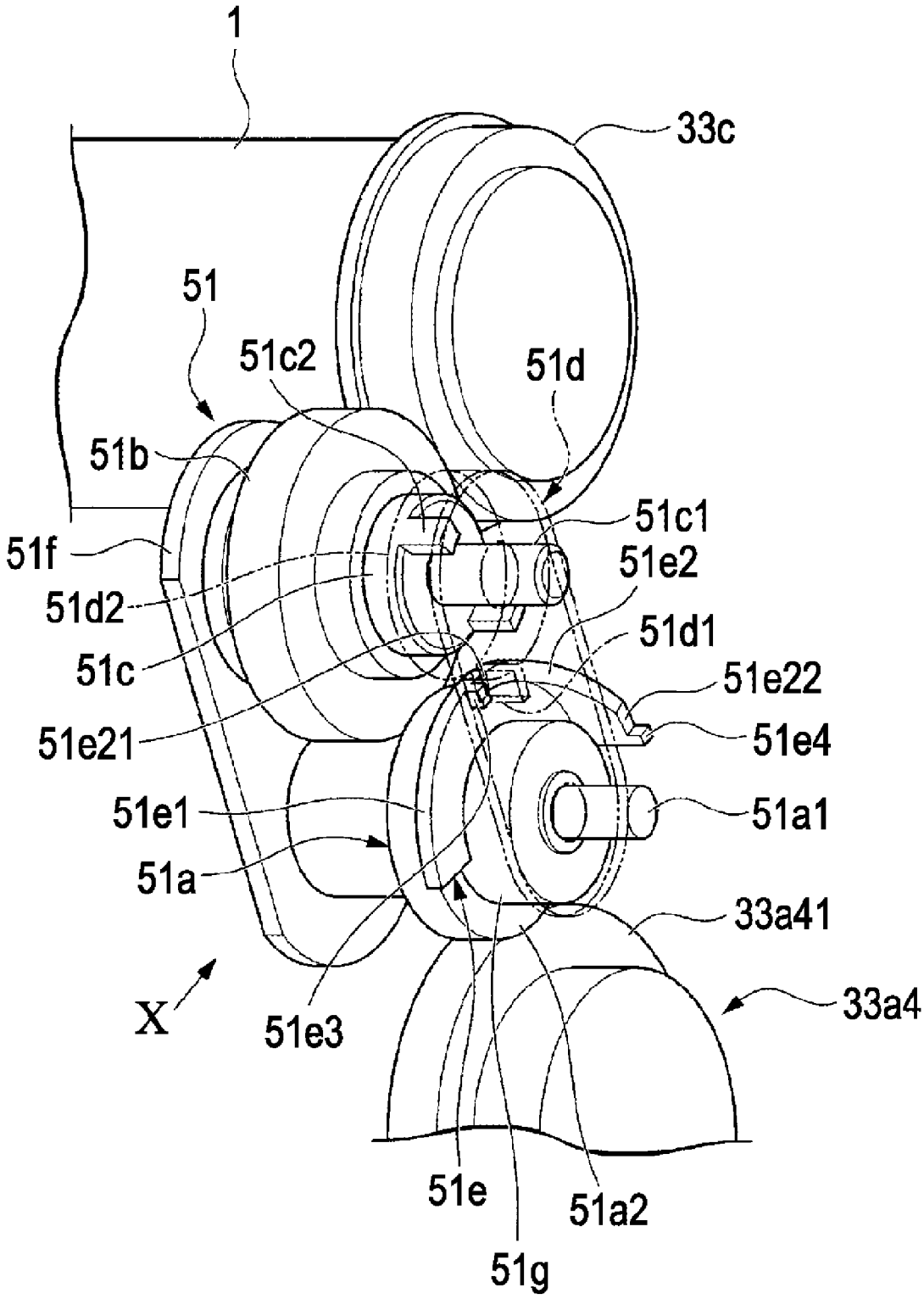
FIG. 9 is an enlarged perspective view of a first torque limiter planetary gear train in a feeding state.
Figure 10:
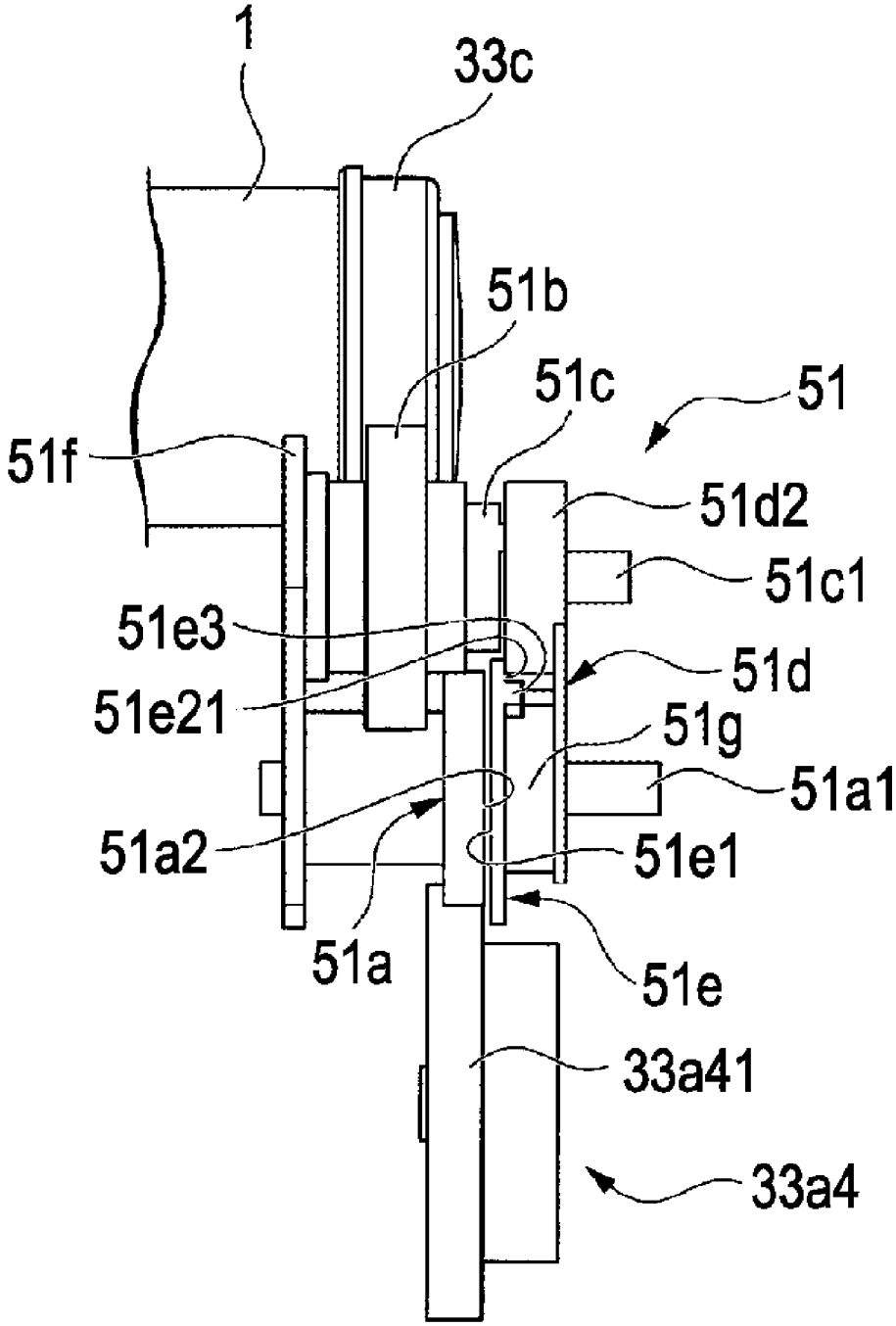
FIG. 10 is a view seen from an arrow X direction in FIG. 9.
Figure 11:
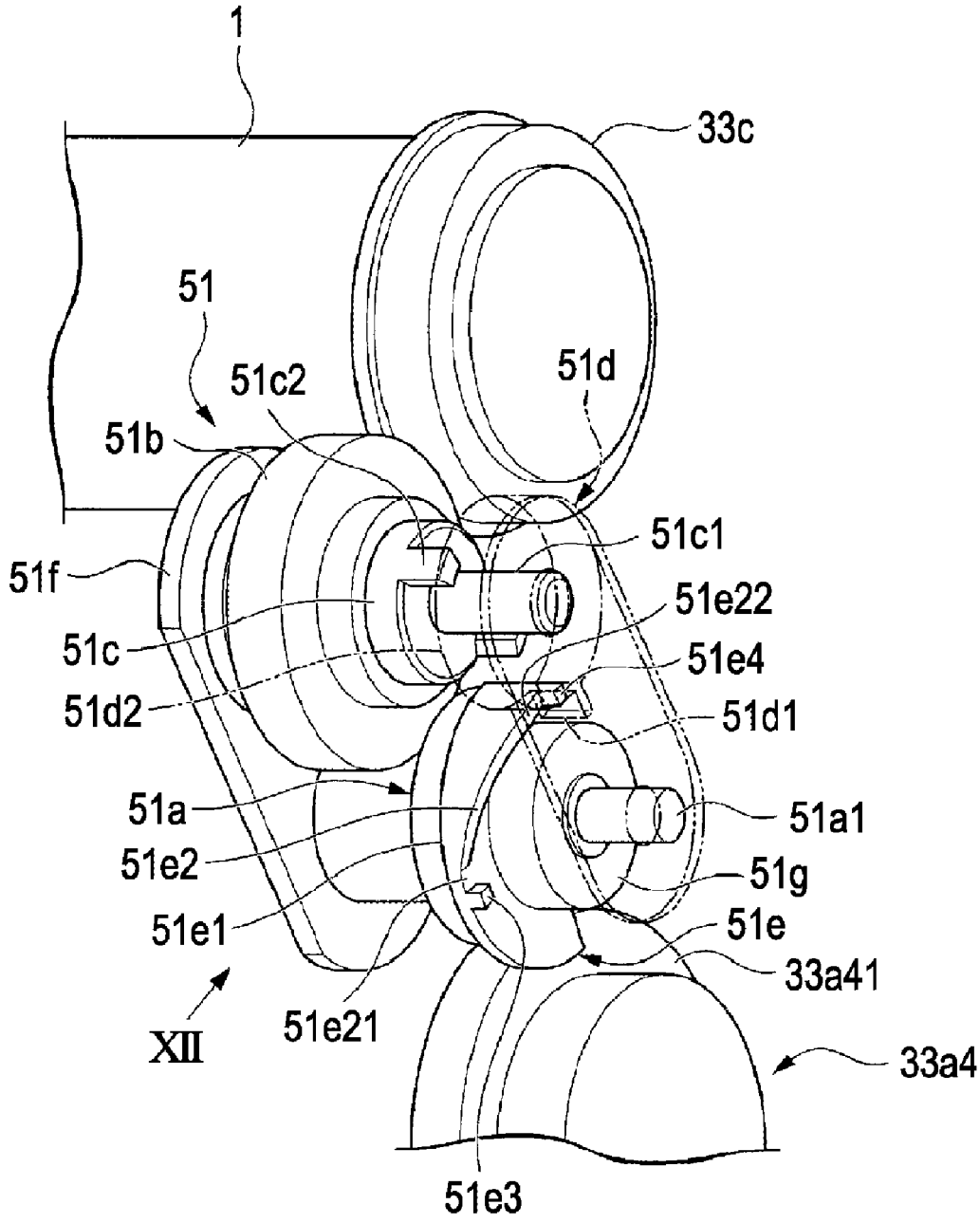
FIG. 11 is an enlarged perspective view of a first torque limiter planetary gear train in a winding state.
Figure 12:
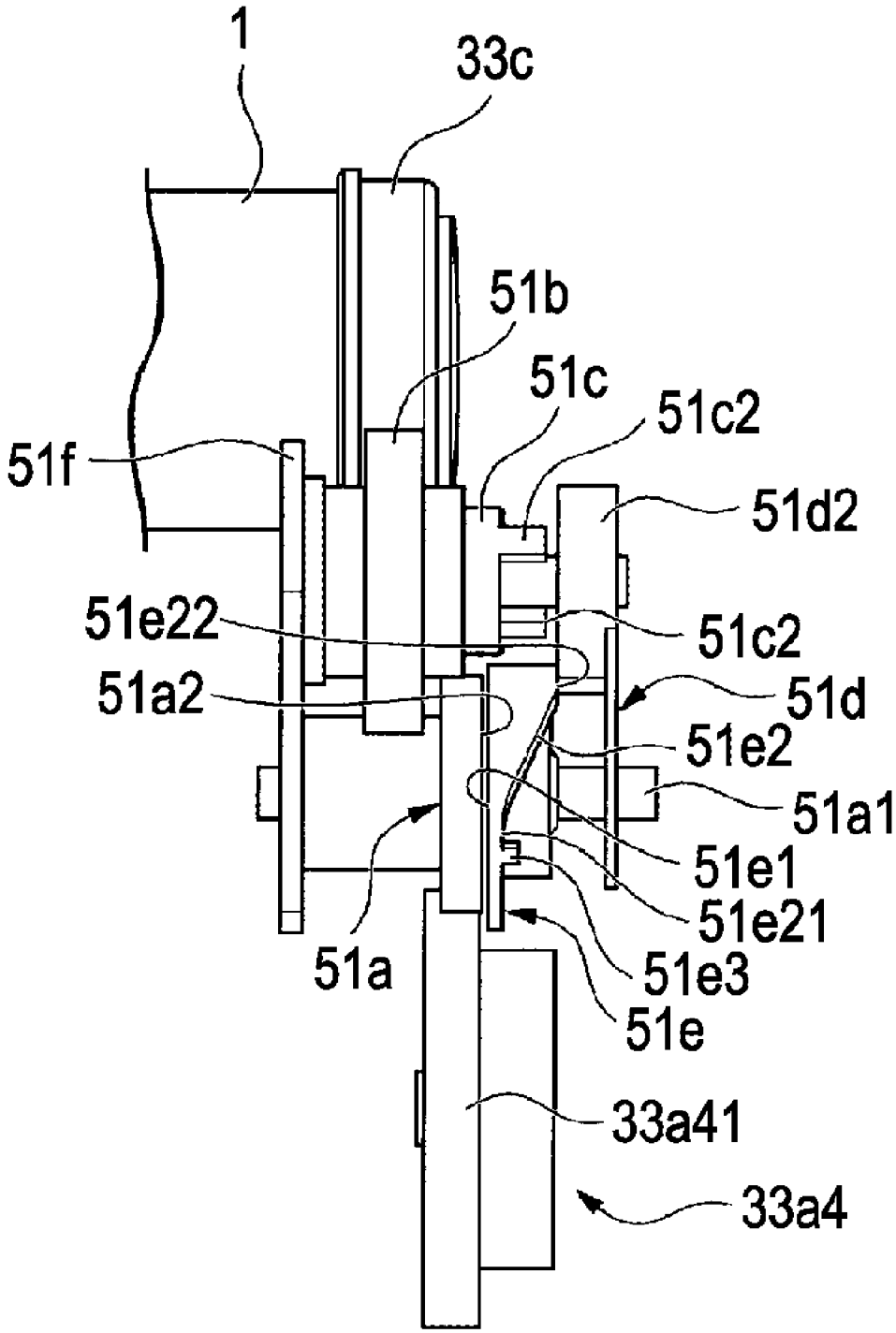
FIG. 12 is a view when seen from an arrow XII direction in FIG. 11.

FIG. 9 is an enlarged perspective view in the vicinity of the first torque limiter planetary gear train 51 of the paper feeding device PF in the paper feeding state shown in FIG. 1. FIG. 10 is a view seen from an arrow X direction in FIG. 9. FIG. 11 is an enlarged perspective view in the vicinity of the first torque limiter planetary gear train 51 of the paper feeding device PF in the winding state shown in FIG. 2. FIG. 12 is a view seen from an arrow XII direction in FIG. 11.

As shown in FIGS. 9 to 12, the first torque limiter planetary gear train 51 includes a connection member 51*f* for supporting the rotation shaft 51*a*1 of the sun gear 51*a* and the rotation shaft 51*c*1 of the first high resistance torque limiter 51*c*. The connection member 51*f* supports the rotation shaft 51*a*1 of the sun gear 51*a* and the rotation shaft 51*c*1 of the first high resistance torque limiter 51*c* such that they are parallel to the support shaft 1. Furthermore, the connection member 51*f* is provided so as to be rotatable around the rotation shaft 51*a*1 of the sun gear 51*a*. Between the connection member 51*f* and the rotation shaft 51*a*1 of the sun gear 51*a*, a pressing member 51*g* is provided which presses the holder 51*d* in the rotation direction of the planetary gear 51*a* and rotatably supports the rotation shaft 51*a*1 of the sun gear 51*a*.

The sun gear 51*a* of the first torque limiter planetary gear train 51 is engaged and connected with a fourth gear 33*a*4 of a driving force transmission gear train 33*a* described later.

The holder 51*d* is provided such that it has the rotation shaft 51*c*1 of the first high resistance torque limiter 51*c* and the rotation shaft 51*a*1 of the sun gear 51*a* inserted therein and is provided movably in the direction parallel to the longitudinal direction. Furthermore, the holder 51*d* is pressed toward the first high resistance torque limiter 51*c* by means of a pressing member (not shown) such as a spring, and a contact portion 51*d*1 comes into contact with the cam 51*e* and is supported by the cam 51*e*.

Additionally, as shown in FIGS. 9 and 10, the holder 51*d* includes a fitting portion 51*d*2 which is fitted to a convex portion 51*c*2 of the first high resistance torque limiter 51*c* when near the first high resistance torque limiter 51*c*. The fitting portion 51*d*2 of the holder 51*d* fixes the first high resistance torque limiter 51*c* in a non-rotatable manner by being fitted to the convex portion 51*c*2 of the first high resistance torque limiter 51*c*.

Furthermore, as shown in FIGS. 11 and 12, the holder 51*d* is configured such that the fitting of the fitting portion 51*d*2 and the convex portion 51*c*2 of the first high resistance torque limiter 51*c* is released when the holder 51*d* is separated from the first high resistance torque limiter 51*c*.

The first high resistance torque limiter 51*c* is provided rotatably around the rotation shaft 51*c*1 together with the planetary gear 51*b* in a state in which the fitting with the holder 51*d* is released and opened.

The cam 51*e* has a sliding surface 51*e*1 which slidably contacts the rotation surface 51*a*2 of the sun gear 51*a*, and is provided rotatably around the rotation shaft 51*a*1 of the sun gear 51*a*. Furthermore, the cam 51*e* has a support surface 51*e*2 for supporting the contact portion 51*d*1 of the holder 51*d*. The cam 51*e* is provided to move the support surface 51*e*2 in the rotation direction of the sun gear 51*a* perpendicular to the longitudinal direction of the rotation shaft 51*a*1 with respect to the holder 51*d* by rotating around the rotation shaft 51*a*1.

The support surface 51*e*2 is provided to be sloped with respect to a plane perpendicular to the longitudinal direction of the rotation shaft 51*c*1 of the first high resistance torque limiter 51*c*. Furthermore, the support surface 51*e*2 is provided on the outer edge portion of the cam 51*e* along a circumferential direction of the sun gear 51*a*. As shown in FIG. 9, on the support surface 51*e*2, a first support portion 51*e*21 is provided, which supports the contact portion 51*d*1 of the holder 51*d* in a state in which the fitting portion 51*d*2 of the holder 51*d* is fitted to the convex portion 51*c*2 of the first high resistance torque limiter 51*c*. Furthermore, as shown in FIG. 11, on the support surface 51*e*2, a second support portion 51*e*22 is provided, which supports the holder 51*d* in a state of not being fitted to the convex portion 51*c*2 of the first high resistance torque limiter 51*c*.

The first support portion 51*e*21 is provided on the side of the support surface 51*e*2 which is nearest to the first high resistance torque limiter 51*c*, in the longitudinal direction of the rotation shaft 51*a*1 of the sun gear 51*a*, and the second support portion 51*e*22 is provided on the side of the support surface 51*e*2 which is furthermost from the first high resistance torque limiter 51*c* of the support surface 51*e*2. Additionally, the first support portion 51*e*21 is provided in the CCW direction of the rotation direction of the sun gear 51*a* of the second support portion 51*e*22.

A protrusion-shaped first stopper 51*e*3 is provided on the end portion of the first support portion 51*e*21 in the CCW direction. A protrusion-shaped second stopper 51*e*4 is provided on the end portion of the second support portion 51*e*22 in the CW direction. The cam 51*e* rotates in the CW direction and the CCW direction through an angle range from a state in which the first stopper 51*e*3 shown in FIG. 9 comes in contact with the contact portion 51*d*1 of the holder 51*d* to a state in which the second stopper 51*e*4 shown in FIG. 11 comes in contact with the contact portion 51*d*1.

The first high resistance torque limiter 51*c* is provided to give the rotation resistance when the planetary gear 51*b* rotates by being fitted and fixed to the holder 51*d*. Furthermore, the rotation resistance given by the first high resistance torque limiter 51*c* is, for example, about 1 kgf·cm and is larger than the rotation resistance given by the low resistance torque limiter 33*b*2. As the first high resistance torque limiter 51*c*, for example, a mechanical type or a hydraulic type can be used.

Moreover, the first torque limiter planetary gear train 51 is disposed so as to be sloped in the CCW direction with respect to the vertical direction in the rotatable range. For that reason, in a case where the connection member 51*f* is not pressed in the CW direction by means of the CW rotation of the sun gear 51*a*, a gravity acts on the first torque limiter planetary gear train 51 to generate the rotational force in the CCW direction. In the present embodiment, the pressing force of the pressing member 51*g* in the CW direction is greater than the rotational force in the CCW direction due to the gravity acting on the first torque limiter planetary gear train 51.

For that reason, the first torque limiter planetary gear train 51 is prevented from rotating in the CCW direction due to the gravity, even when the sun gear 51*a* stops after the CW rotation. As a result, when the sun gear 51*a* stops after CW rotation, the engagement of the support shaft gear 33*c* and the planetary gear 51*b* is prevented from being disengaged, which can prevent the connection from releasing. The first torque limiter planetary gear train 51 is provided so as to separate the planetary gear 51*b* from the support shaft gear 33*c* when the slope in the CCW direction is the maximum, thereby releasing the connection.

The connection planetary gear train 42, which constitutes the support shaft gear train 33 of the driving force transmission unit 3 and the driving force switching unit 4, includes a sun gear 42*a* connected to the driving force transmission gear train 33*a*, a planetary gear 42*b* engaged with the sun gear 42*a*, and a holder 42*c* which supports the rotation shaft of the planetary gear 42*b* and supports the planetary gear 42*b* rotatably around the rotation shaft of the sun gear 42*a*.

As shown in FIGS. 1 to 4 and 8, the connection planetary gear train 42 is disposed so as to be sloped in the CW direction with respect to the vertical direction within the rotatable range. For that reason, when the holder 42*c* is not pressed in the CCW direction by means of the CCW rotation of the sun gear 42*a*, the gravity acts on the holder 42*c*, so that the slope in the CW direction becomes the maximum. The connection planetary gear train 42 is provided so as to separate the planetary gear 42*b* from the sun gear 52*a* of the second torque limiter planetary gear train 52 when the slope of the holder 42*c* in the CCW direction is the maximum, thereby releasing the connection.

The second torque limiter planetary gear train 52, which constitutes the support shaft driving gear train 33 of the driving force transmission unit 3, the driving force switching unit 4, and the rotation resistance switching unit 5, includes a sun gear (a center gear) 52*a*, which is provided so as to be engageable with the planetary gear 42*b* of the connection planetary gear train 42, a planetary gear (a rotation gear) 52*b* engaged with the sun gear 52*a*, a holder 52*c*, which supports the rotation shaft of the planetary gear 52*b* and supports the planetary gear 52*b* rotatably around the rotation shaft of the sun gear 52*a*, and a second high resistance torque limiter (a second torque limiter) 52*d* provided integrally with the planetary gear 52*b*.

The second high resistance torque limiter 52*d* is provided so as to give the rotation resistance of, for example, about 1 kgf·cm when the planetary gear 52*b* rotates. Furthermore, the rotation resistance given by the second high resistance torque limiter 52*d* is greater than that given by the low resistance torque limiter 33*b*2. As the second high resistance torque limiter 52*d*, for example, a mechanical type or a hydraulic type can be used.

As shown in FIG. 8, on the planetary gear 52*b* of the second torque limiter planetary gear 52, a first external gear 52*b*1, which is engaged with the external gear of the sun gear 52*a*, and a second external gear 52*b*2, which is provided so as to be engageable with the low resistance torque limiter gear 33*b*1 of the low resistance torque limiter gear train 33*b*, are provided so as to be adjacent to each other in the rotation shaft direction. That is, the planetary gear 52*b* of the second torque limiter planetary gear train 52 is provided so as to transmit the driving force, which has been transmitted from the sun gear 52*a*, to the support shaft 1, by being connected with the support shaft gear 33*c* via the low resistance torque limiter gear 33*b*1.

Furthermore, the second torque limiter gear train 52 is disposed so as to be sloped in the CW direction with respect to the vertical direction within the rotatable range thereof. For that reason, when the holder 52*c* is not pressed on the CCW direction by means of the CCW rotation of the sun gear, the gravity acts on the holder 52*c*, so that the slope in the CW direction becomes the maximum. The second torque limiter planetary gear train 52 is provided so as to separate the planetary gear 52*b* from the low resistance torque limiter gear 33*b*1 when the slope of the holder 52*c* in the CCW direction is the maximum, thereby releasing the connection.

Furthermore, a lock mechanism (not shown) by, for example, a solenoid driving or a latch cam mechanism is provided on the second torque limiter planetary gear train 52. The lock mechanism can fix the holder 52*c* in that state by operating the holder 52*c* in the state of rotating in the rotation direction of the sun gear 52*a*.

The driven roller holder 71 constituting the driven roller moving unit 7 is a frame-shaped member for rotatably supporting the driven roller 6 and has a contact portion 71*a* which comes in contact with the outer edge portion of the eccentric cam 72. Furthermore, the driven holder 71 is provided so as to be rotatable around the rotation shaft 71*b*.

The eccentric cam 72 is fixed to the rotation shaft 73 and is provided so as to rotate integrally with the rotation shaft 73. The eccentric cam 72 is formed in the shape of an egg, in which the diameter from the center of the rotation shaft 73 to the outer edge portion is not constant, and has a short diameter portion 72*a* with a short diameter and a long diameter portion 72*b* with a long diameter. The eccentric cam 72 is provided to rotate around the rotation shaft 73 and respectively move the driven roller 6 to the pinch position shown in FIG. 1 and the open position shown in FIG. 2 by supporting the driven roller holder 71 with the short diameter portion 72*a* and the long diameter portion 72*b*.

As shown in FIGS. 5 to 7, on the complex gear 75, from the front side toward the bottom side in the rotation shaft direction, a first half-turn gear (a first partial gear) 75*a*, a cam driving gear 75*c*, and a second half-turn gear (a second partial gear) 75*b* are provided. The first half-turn gear 75*a* and the second half-turn gear 75*b* are provided in the different angle ranges of the complex gear 75 by the half-turn of the complex gear 75 and include external gears all over the formed angle range. The cam driving gear 75*c* provided between the first half-turn gear 75*a* and the second half-turn gear 75*b* includes external gears all over the complex gear 75 and is engaged and connected with the eccentric cam gear 74 provided on the rotation shaft 73 of the eccentric cam 72.

The three consecutive planetary gear train 41, which constitutes the feeding roller driving gear train 32 of the driving force transmission unit 3 and the driving force switching unit 4, includes an outer ring 41*a*, a sun gear 41*b*, a first planetary gear 41*c*, a second planetary gear 41*d*, and a third planetary gear 41*e*.

The outer ring 41*a* of the three consecutive planetary gear train 41 has an external gear, which is engaged with the driving shaft gear 31, provided at the outer periphery thereof and is provided to cover the first planetary gear 41*c*, the second planetary gear 41*d*, and the third planetary gear 41*e*. The sun gear 41*b* is provided on the rotation center of the outer ring 41*a*. In addition, in FIGS. 1 to 4 and 8, in order to easily understand the relationship of the plurality of gears, the outer ring 41*a* is shown in a partly cut state.

The sun gear 41*b* of the three consecutive planetary gear train 41 is disposed in the rotation center of the outer ring 41*a* and is connected so as to be rotatable integrally with the outer ring 41*a*. Outer gears are provided on the outer periphery of the sun gear 41*b* all over the periphery thereof. The sun gear 41*b* is engaged with the first planetary gear 41*c*, the second planetary gear 41*d*, and the third planetary gear 41*e*, which are disposed around the sun gear 41*b*.

The first planetary gear 41*c*, the second planetary gear 41*d*, and the third planetary gear 41*e* of the three consecutive planetary gear train 41 are equally disposed in the inner side of the outer ring 41*a* along the circumferential direction of the sun gear 41*b*. The first planetary gear 41*c* to the third planetary gear 41*e* are configured such that the external gears formed all over the respective outer peripheries are engaged with the external gears of the sun gear 41*b*, respectively. Furthermore, the first planetary gear 41*c* to the third planetary gear 41*e* are connected to each other, by being rotatably supported by the rotation shaft provided on the connection member 41*f*, respectively.

The connection member 41*f* of the three consecutive planetary gear train 41 is an approximately triangular plate-shaped member with a circle, and the respective rotation shafts of the first planetary gear 41*c* to the third planetary gear 41*e* are provided on each of the three peaks. The connection member 41*f* is provided such that the center portion thereof is slidably supported by the rotation shaft of the sun gear 41*b* and the connection member 41*f* can rotate in the rotation direction of the sun gear 41*b*. It is configured such that the connection member 41*f* rotates in the rotation direction of the sun gear 41*b*, whereby the first planetary gear 41*c* to the third planetary gear 41*e* rotate integrally in the rotation direction of the sun gear 41*b*.

As shown in FIGS. 5 to 7, the first planetary gear 41*c* is provided on the bottom side in the rotation shaft direction relative to the second planetary gear 41*d* so as to be engageable with the second feeding roller gear train 32*a*2 of the feeding roller driving gear train 32. Furthermore, the second planetary gear 41*d* is provided on the front side in the rotation shaft direction relative to the first planetary gear 41*c* and the third planetary gear 41*e* so as to be engageable with the first half-turn gear 75*a* of the complex gear 75. Moreover, the third planetary gear 41*e* is provided on the bottom side in the rotation shaft direction relative to the second planetary gear 41*d* so as to be engageable with the second half-turn gear 75*b* of the complex gear 75.

As shown in FIGS. 1 to 4 and 8, the driving force transmission gear train 33*a*, which constitutes the support shaft driving gear train 33 of the driving force transmission unit 3, includes a first gear 33*a*1 engaged with the driving shaft gear 31, a second gear 33*a*2 engaged with the first gear 33*a*1, a third gear 33*a*3 engaged with the second gear 33*a*2, and a fourth gear 33*a*4 engaged with the third gear 33*a*3. The first gear 33*a*1 to the fourth gear 33*a*4 are set to suitable outer diameters considering the respective gear ratios or the like.

The second gear 33*a*2 has an outer periphery external gear 33*a*21, which is provided on the outer periphery portion and is engaged with the first gear 33*a*1, and an inner periphery external gear 33*a*22 which is provided on the inner periphery portion and is engaged with the third gear 33*a*3. The third gear 33*a*3 has an outer periphery external gear 33*a*31, which is provided on the outer periphery portion and is engaged with the inner periphery external gear 33*a*22 of the second gear 33*a*2, and an inner periphery external gear 33*a*32 which is provided on the inner periphery portion and is engaged with the fourth gear 33*a*4. The fourth gear 33*a*4 has an outer periphery external gear 33*a*41, which is provided on the outer periphery portion and is engaged with the inner periphery external gear 33*a*32 of the third gear 33*a*3, and an inner periphery external gear 33*a*42 which is provided on the inner periphery portion and is engaged with the connection planetary gear train 42. The outer periphery external gear 33*a*41 of the fourth gear 33*a*4 is engaged and connected with the sun gear 51*a* of the first torque limiter planetary gear train 51. The inner periphery external gear 33*a*42 of the fourth gear 33*a*4 is engaged and connected with the sun gear 42*a* of the connection planetary gear train 42.

Next, an operation of the paper feeding device PF in the paper feeding state will be described.

When the motor rotates forward in the paper feeding device PF, as shown in FIG. 1, the driving shaft gear 31 performs the CCW rotation, so that the driving force is transmitted to the outer ring 41*a* of the three consecutive planetary gear train 41 engaged with the driving shaft gear 31. Then, the outer ring 41*a* performs the CW rotation and the sun gear 41*b* provided integrally with the outer ring 41*a* performs the CW rotation, whereby the driving force of the sun gear 41*b* is transmitted to the first planetary gear 41*c* to the third planetary gear 41*e*. Furthermore, the CW rotation of the sun gear 41*b* presses the connection member 41*f* in the CW direction.

Then, the first planetary gear 41*c* to the third planetary gear 41*e* perform the CCW rotation (rotation) and integrally rotate (revolution) around the rotation shaft of the sun gear 41*b* in the CW direction. In addition, the first planetary gear 41*c* is engaged and connected with the second feeding roller gear 32*a*2 of the feeding roller gear train 32*a*. As a result, the driving force is transmitted from the first planetary gear 41*c* to the second feeding roller gear 32*a*2, so that the second feeding roller gear 32*a*2 performs the CW rotation. Then, the driving force is transmitted to the first feeding roller gear 32*a*1 engaged with the second feeding roller gear 32*a*2, and the first feeding roller gear 32*a*1 performs the CCW rotation together with the rotation shaft, so that the feeding roller 2 performs the CCW rotation.

In this manner, the three consecutive planetary gear train 41, which constitutes the driving force switching unit 4 and the driving force transmission unit 3, is provided to transmit the driving force of the motor to the feeding roller 2 via the driving shaft gear 31 and the feeding roller gear train 32*a*, which constitute the driving force transmission unit 3, by means of the forward rotation of the motor.

Furthermore, as shown in FIG. 1, when the driving shaft gear 31 performs the CCW rotation by the forward rotation of the motor, the driving force of the motor is sequentially transmitted from the first gear 33*a*1 to the fourth gear 33*a*4 of the driving force transmission gear train 33*a*. As a result, the first gear 33*a*1 performs the CW rotation, the second gear 33*a*2 performs the CCW rotation, the third gear 33*a*3 performs the CW rotation, and the fourth gear 33*a*4 performs the CCW rotation. Then, the driving force transmitted from the fourth gear 33*a*4 causes the sun gear 42*a* of the connection planetary gear train 42 to perform the CW rotation and causes the planetary gear 42*b* to perform the CCW rotation. Furthermore, the holder 42*c* of the connection planetary gear train 42 is pressed in the CW direction by means of the CW rotation of the sun gear 42*a*, so that the planetary gear 42*b* enters the state of rotating (revolution) around the rotation shaft of the sun gear 42*a* in the CW direction.

As a result, the engagement of the planetary gear 42*b* of the connection planetary gear train 42 and the sun gear 52*a* of the second torque limiter planetary gear train 52 is disengaged and the connection is released, so that the transmission of the driving force of the motor is cut between the gears. Thus, the driving force of the motor is not transmitted to the support shaft 1 during forward rotation of the motor.

Furthermore, in the state in which the driving force of the motor is not transmitted to the sun gear 52*a* of the second torque limiter planetary gear train 52, as shown in FIG. 1, the second torque limiter planetary gear train 52 is in the open state in which the connection of the second torque limiter planetary gear train 52 and the support shaft 1 via the planetary gear 52*b* and the low resistance torque limiter gear 33*b*1 is released due to the gravity acting on the holder 52*c*. That is, the second torque limiter planetary gear train 52 rotates to release the connection of the second high resistance torque limiter 52*d* and the support shaft 1 by means of the forward rotation of the motor.

As described above, the connection planetary gear train 42 and the second torque limiter planetary gear train 52, which constitute the driving force switching unit 4 and the driving force transmission unit 3, are provided to cut the transmission of the driving force of the motor between the connection planetary gear train 42 and the second torque limiter planetary gear train 52 and between the second torque limiter planetary gear train 52 and the low resistance torque limiter gear train 33*b*, by means of the forward rotation of the motor.

Furthermore, when the fourth gear 33*a*4 of the driving force transmission gear train 33*a* performs the CCW rotation, the sun gear 51*a* of the first torque limiter planetary gear train 51 performs the CW rotation by means of the driving force transmitted from the fourth gear 33*a*4.

As shown in FIGS. 11 and 12, in the open state in which the fitting portion 51*d*2 of the holder 51*d* is not fitted to the convex portion 51*c*2 of the first high resistance torque limiter 51*c*, when the sun gear 51*a* performs the CW rotation, the rotation surface 51*a*2 of the sun gear 51*a* and the sliding surface 51*e*1 of the cam 51*e* slide.

Then, the cam 51*e* rotates in the CW direction due to the frictional force acting on the sliding surface 51*e*1. When the cam 51*e* rotates in the CW direction, the support surface 51*e*2 moves in the CW direction of the circumferential direction of the sun gear 51*a*, which is perpendicular to the rotation shaft 51*a*1 of the sun gear 51*a*, with respect to the holder 51*d*. In addition, the contact portion 51*d*1 of the holder 51*d* relatively moves on the support surface 51*e*2 from the second support portion 51*e*22 toward the first support portion 51*e*21.

Herein, the support surface 51*e*2 is provided so as to be sloped with respect to the plane perpendicular to the rotation shaft 51*a*1 of the sun gear 51*a*, and the first support portion 51*e*21 is provided on the side closer to the cam 51*e* than the second support portion 51*e*22. Furthermore, the holder 51*d* is pressed toward the cam 51*e*. For that reason, as the cam 51*e* rotates in the CW direction and the contact portion 51*d*1 of the holder 51*d* relatively moves on the support surface 51*e*2 and approaches the first support portion 51*e*21, the holder 51*d* gradually approaches the first high resistance torque limiter 51*c*.

In addition, as shown in FIG. 9, when the contact portion 51*d*1 of the holder 51*d* reaches the first support portion 51*e*21 to contact the first stopper 51*e*3, the fitting portion 51*d*2 of the holder 51*d* is fitted to the convex portion 51*c*2 of the first high resistance torque limiter 51*c*, whereby the first high resistance torque limiter 51*c* is fixed around the rotation shaft 51*c*1 in a non-rotatable manner. As a result, the first high resistance torque limiter 51*c* enters the state of being capable of giving the rotation resistance when the planetary gear 51*b* rotates.

Furthermore, as shown in FIG. 11, in the state in which the first torque limiter planetary gear train 51 rotates in the CCW direction, so that the planetary gear 51*b* is separated from the support shaft gear 33*c*, when the sun gear 51*a* performs the CW rotation, the connection member 51*f* is pressed in the rotation direction of the sun gear 51*a* by means of the pressing member 51*g* and rotates around the rotation shaft 51*a*1 of the sun gear 51*a* in the CW direction.

Then, as shown in FIG. 9, the planetary gear 51*b* is engaged and connected with the support shaft gear 33*c*. As a result, the support shaft 1 enters the limitation state in which the rotation resistance is given by the first high resistance torque limiter 51*c* when rotating. Herein, the planetary gear 51*b* is not engaged and not connected with the sun gear 51*a*. Thus, the driving force is not transmitted from the sun gear 51*a* to the planetary gear 51*b*, so that the planetary gear 51*b* is in the state of being capable of rotating independently from the sun gear 51*a*.

Herein, the pressing force of the pressing member 51*g* in the CW direction is greater than the rotational force in the CCW direction due to the gravity acting on the first torque limiter planetary gear train 51. For that reason, even when the sun gear 51*a* stops after the CW rotation, the first torque limiter planetary gear train 51 is prevented from performing the CCW rotation due to the gravity. As a result, when the sun gear 51*a* stops after the CW rotation, the engagement of the support shaft gear 33*c* and the planetary gear 51*b* is prevented from being disengaged, which makes it possible to prevent the connection from being released. Thus, even when the motor is stopped after the paper feeding to stop the rotation of the support shaft 1, it is possible to give the support shaft 1 the rotation resistance due to the first high resistance torque limiter 51*c*, whereby the revolution of the support shaft 1 can be prevented to continuously give the recording paper P tension.

Figure 2:
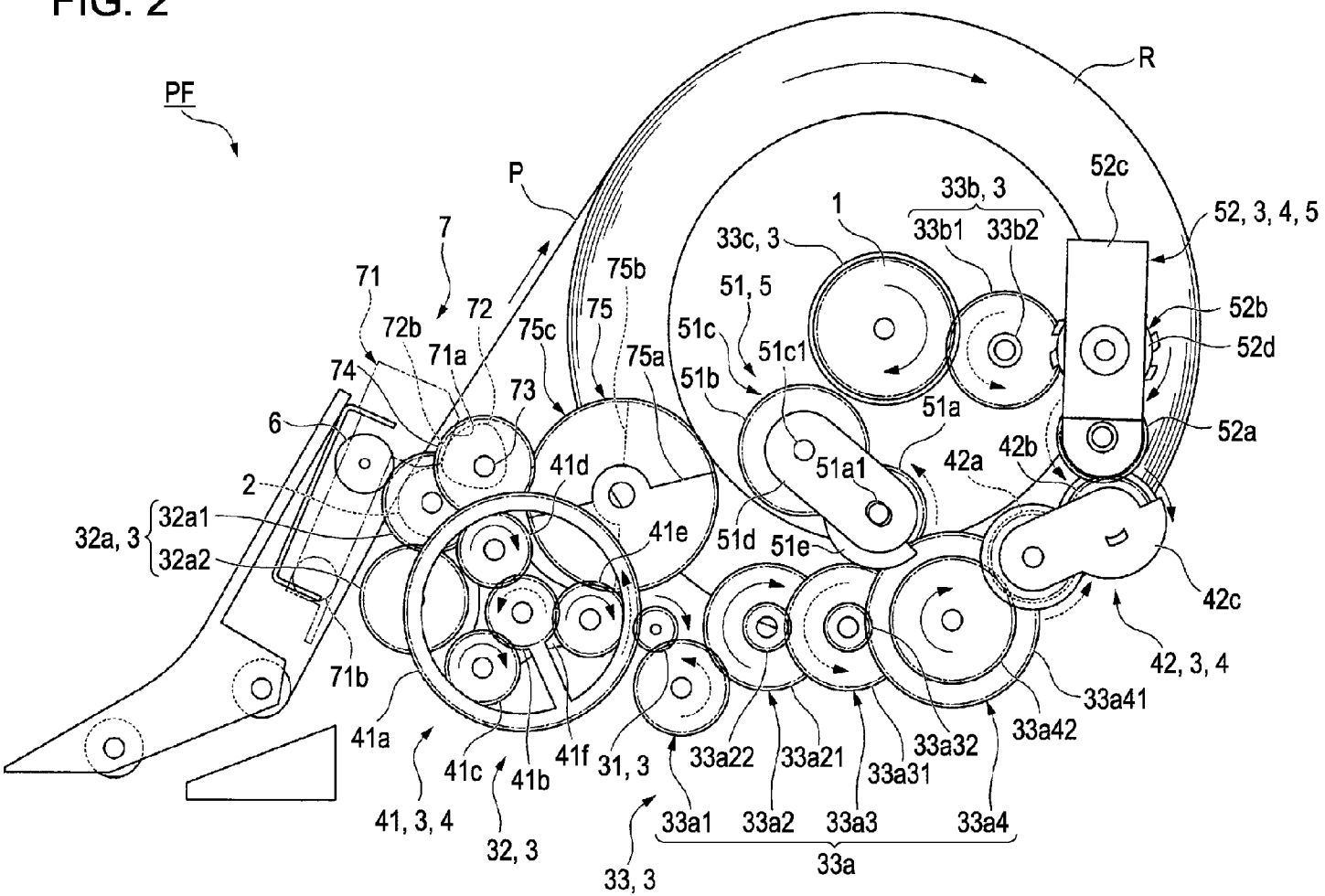
FIG. 2 is a side view in a winding state of the paper feeding device in FIG. 1.

Furthermore, as shown in FIG. 2, in the open state in which the driven roller 6 is separated from the feeding roller 2, the long diameter portion 72*b* of the eccentric cam 72 is in contact with the contact portion 71*a* of the driven roller holder 71. When the motor rotates forward in this state and the driving shaft gear 31 performs the CCW rotation as shown in FIG. 5A, the outer ring 41*a* and the sun gear 41*b* of the three consecutive planetary gear train 41 perform the CW rotation, and the first planetary gear 41*c* to the third planetary gear 41*e* perform the CCW rotation. Furthermore, the CW rotation of the sun gear 41*b*, the connection member 41*f* is pressed in the CW rotation direction, whereby the first planetary gear 41*c* to the third planetary gear 41*e* rotate integrally in the CW rotation direction.

Then, as shown in FIG. 6A, the connection of the third planetary gear 41*e* and the second half-turn gear 75*b* of the complex gear 75 is released and separated, whereby, as shown in FIG. 6B, the first planetary gear 41*c* is engaged and connected with the second feeding roller gear 32*a*2. As a result, as shown in FIG. 5A, the second feeding roller gear 32*a*2 performs the CW rotation, the first feeding roller gear 32*a*1 performs the CCW rotation, and the feeding roller 2 performs the CCW rotation.

Moreover, as shown in FIG. 5A, the second planetary gear 41*d* is engaged and connected with the first half-turn gear 75*a* situated on the lower half of the complex gear 75. Then, the driving force of the motor is transmitted from the second planetary gear 41*d* to the first half-turn gear 75*a*, whereby the complex gear 75 performs the CW rotation. Then, the driving force is transmitted to the eccentric cam gear 74 which is engaged and connected with the cam driving gear 75*c* of the complex gear 75, whereby the eccentric cam gear 74 performs the CCW rotation and the eccentric cam 72 performs the CCW rotation.

When the complex gear 75 rotates by about 180° from the state shown in FIG. 5A in the CW direction, as shown in FIG. 5B, the complex gear 75 enters the state in which the first half-turn gear 75*a* is situated on the half of the upper part. Then, the engagement of the first half-turn gear 75*a* and the second planetary gear 41*d* is disengaged, whereby the rotation of the complex gear 75 stops. As a result, the eccentric cam 72 stops in the state in which the short diameter portion 72*a* is in contact with the contact portion 71*a* of the driven roller holder 71. The driven roller holder 71 moves from a position shown in FIG. 5A to a position shown in FIG. 5B by means of the rotation of the eccentric cam 72, whereby the driven roller 6 is disposed at the pinch position capable of pinching the recording paper P between the driven roller 6 and the feeding roller 2.

As a result, as shown in FIG. 1, the recording paper P is fed in the feeding direction by means of the CCW rotation of the feeding roller 2 in the state of being pinched between the driven roller 6 and the feeding roller 2. At this time, the driven roller 6 is driven due to the feeding of the recording paper P to perform the CW rotation. When the recording paper P is fed in the feeding direction, the tension is generated in the recording paper P between the feeding roller 2 and the roll R. Then, the tension of the recording paper P acts on the outer periphery of the roll R and the torque acts on the support shaft 1 supporting the roll R, whereby the support shaft 1 performs the CCW rotation. Then, the support shaft gear 33*c* provided on the support shaft 1 performs the CCW rotation, whereby the planetary gear 51*b* of the first torque limiter planetary gear train 51 connected with the support shaft gear 33*c* performs the CW rotation.

At this time, the first high resistance torque limiter 51*c* of the first torque limiter planetary gear train 51 gives the planetary gear 51*b* the rotation resistance, so that the rotation resistance due to the first high resistance torque limiter 51*c* is given from the planetary gear 51*b* to the support shaft gear 33*c*. Thus, as compared to a case where the rotation resistance is given only by the low resistance torque limiter 33*b*2, relatively large rotation resistance of, for example, about 1 kgf·cm is given to the support shaft 1, whereby the high tension can be given to the recording paper P. As a result, during paper feeding in which the recording paper P is fed by the feeding roller 2, it is possible to give the recording paper P a suitable tension to reduce a skew of the recording paper P.

In addition, the support shaft 1 performs the CCW rotation in the state in which the rotation resistance is given even from the low resistance torque limiter 33*b*2 via the low resistance torque limiter gear 33*b*1. However, since the rotation resistance given to the support shaft 1 by the first high resistance torque limiter 51*c* is greater than that given to the support shaft 1 by the low resistance torque limiter 33*b*2, the rotation resistance by the first high resistance torque limiter 51*c* becomes dominant.

Next, an operation of the paper feeding device PF in the winding state will be described.

When the motor rotates backward relative to the paper feeding device PF, as shown in FIG. 2, the driving shaft gear 31 performs the CW rotation, and the driving force is transmitted to the outer ring 41*a* of the three consecutive planetary gear train 41 engaged with the driving shaft gear 31, so that the outer ring 41*a* and the sun gear 41*b* perform the CCW rotation. Then, the driving force of the sun gear 41*b* is transmitted to the first planetary gear 41*c* to the third planetary gear 41*e*, and the connection member 41*f* is pressed in the CCW direction by means of the CCW rotation of the sun gear 41*b*.

Then, the first planetary gear 41*c* to the third planetary gear 41*e* perform the CW rotation (rotation) and rotate (revolve) integrally in the CCW rotation direction. As a result, the engagement of the first planetary gear 41*c* and the second feeding roller gear 32*a*2 is disengaged and the connection is released. Then, the transmission of the driving force of the motor is cut between the first planetary gear 41*c* and the second feeding roller gear 32*a*2.

As described above, the three consecutive planetary gear train 41 constituting the driving force switching unit 4 is provided to cut the transmission of the driving force of the motor to the feeding roller 2 by means of the backward rotation of the motor between the three consecutive planetary gear train 41 and the second feeding roller gear 32*a*2, which constitute the driving force transmission unit 3.

Furthermore, as shown in FIG. 2, when the backward rotation of the motor causes the driving shaft gear 31 to perform the CW rotation, the first gear 33*a*1 of the driving force transmission gear train 33*a* performs the CCW rotation, the second gear 33*a*2 performs the CW rotation, the third gear 33*a*3 performs the CCW rotation, and the fourth gear 33*a*4 performs the CW rotation. Then, the driving force transmitted from the fourth gear 33*a*4 causes the sun gear 42*a* of the connection planetary gear train 42 to perform the CCW rotation and causes the planetary gear 42*b* to perform the CW rotation (rotation). In addition, the holder 42*c* of the connection planetary gear train 42 is pressed in the CCW direction by means of the CCW rotation of the sun gear 42*a*, and the planetary gear 42*b* enters the state of rotating (revolving) around the rotation shaft of the sun gear 42*a* in the CCW direction.

As a result, the planetary gear 42*b* of the connection planetary gear train 42 is engaged and connected with the sun gear 52*a* of the second torque limiter planetary gear train 52, whereby the driving force of the motor is transmitted between the gears. Then, the driving force is transmitted from the planetary gear 42*b* of the connection planetary gear train 42, the sun gear 52*a* of the second torque limiter planetary gear train 52 performs the CCW rotation, and the planetary gear 52*b* performs the CW rotation. At this time, the rotation resistance from the second high resistance torque limiter 52*d* is given to the planetary gear 52*b*.

Moreover, the holder 52*c* of the second torque limiter planetary gear train 52 is pressed in the CCW direction by means of the CCW rotation of the planetary gear 52*a*, and the planetary gear 52*b* rotates around the rotation shaft of the sun planetary gear 52*a* in the CCW direction. As a result, the planetary gear 52*b* of the second torque limiter planetary gear train 52 and the low resistance torque limiter gear 33*b*1 of the low resistance torque limiter gear train 33*b* are engaged and connected with each other. Then, the driving force of the motor is transmitted, so that the low resistance torque limiter gear 33*b*1 performs the CCW rotation. The low resistance torque limiter gear 33*b*1 causes the support shaft gear 33*c* to perform the CW rotation in the state, in which the rotation resistance is given by the low resistance torque limiter 33*b*2, thereby causing the support shaft 1 to perform the CW rotation. This causes the roll R to perform the CW rotation whereby the recording paper P is wound.

As described above, the connection planetary gear train 42 and the second torque limiter planetary gear train 52, which constitute the driving force transmission unit 3 and the driving force switching unit 4, are provided to transmit the driving force of the motor to the support shaft 1 by means of the backward rotation of the motor, via the driving shaft gear 31, the driving force transmission gear train 33*a*, the low resistance torque limiter gear train 33*b*, and the support shaft gear 33*c*, which constitute the driving force transmission unit 3.

Furthermore, the second high resistance torque limiter 52*d* is connected to the support shaft 1 by means of the backward rotation of the motor, via the planetary gear 52*b* of the second torque limiter planetary gear train 52 and the low resistance torque limiter gear 33*b*1. The support shaft 1 hereby enters the limitation state in which the rotation resistance is given from the second high resistance torque limiter 52*d*.

Moreover, when the fourth gear 33*a*4 of the driving force transmission gear train 33*a* performs the CW rotation, the driving force transmitted from the fourth gear 33*a*4 causes the sun gear 51*a* of the first torque limiter planetary gear train 51 to perform the CCW rotation.

As shown in FIGS. 9 and 10, in the fixed state in which the fitting portion 51*d*2 of the holder 51*d* is fitted to the convex portion 51*c*2 of the first high resistance torque limiter 51*c*, when the sun gear 51*a* performs the CCW rotation, the rotation surface 51*a*2 of the sun gear 51*a* and the sliding surface 51*e*1 of the cam 51*e* slide.

Then, the cam 51*e* rotates in the CCW direction by means of the frictional force acting on the sliding surface 51*e*1. When the cam 51*e* rotates in the CCW direction, the support surface 51*e*2 moves in the CCW direction of the circumferential direction of the sun gear 51*a*, which is perpendicular to the rotation shaft 51*a*1 of the sun gear 51*a* with respect to the holder 51*d*. In addition, the contact portion 51*d*1 of the holder 51*d* gradually moves on the support surface 51*e*2 from the first support portion 51*e*21 toward the second support portion 51*e*22.

Herein, the support surface 51*e*2 is provided obliquely with respect to the plane perpendicular to the rotation shaft 51*a*1 of the sun gear 51*a*, and the first support portion 51*e*21 is provided on the side closer to the cam 51*e* than the second support portion 51*e*22. Furthermore, the holder 51*d* is pressed toward the cam 51*e*. For that reason, as the cam 51*e* rotates and the contact portion 51*d*1 of the holder 51*d* relatively moves on the support surface 51*e*2 and approaches the second support portion 51*e*22, the holder 51*d* is gradually separated from the first high resistance torque limiter 51*c*.

In addition, as shown in FIG. 11, when the contact portion 51*d*1 of the holder 51*d* reaches the second support portion 51*e*22 and comes in contact with the second stopper 51*e*4, the fitting of the fitting portion 51*d*2 of the holder 51*d* with the convex portion 51*c*2 of the first high resistance torque limiter 51*c* is released, and the first high resistance torque limiter 51*c* is opened so as to be rotatable around the rotation shaft 51*c*1. As a result, the first high resistance torque limiter 51*c* enters the open state of not giving the rotation resistance when the planetary gear 51*b* rotates.

Furthermore, as shown in FIG. 9, in the state in which the first torque limiter planetary gear train 51 rotates in the CW direction to engage and connect with the planetary gear 51*b* and the support shaft gear 33*c*, when the sun gear 51*a* rotates in the CCW direction, the connection member 51*f* is pressed in the rotational direction of the sun gear 51*a* by means of the pressing member 51*g* and rotates around the rotation shaft 51*a*1 in the CCW direction.

Then, as shown in FIG. 11, the planetary gear 51*b* is separated from the support shaft gear 33*c* and this connection is released. The support shaft 1 hereby enters the open state in which the rotation resistance is not given by the first high resistance torque limiter 51*c* during rotation.

As shown in FIG. 1, in the pinch state in which the driven roller 6 and the feeding roller 2 can approach each other to pinch the recording paper P therebetween, the short diameter portion 72*a* of the eccentric cam 72 is in contact with the contact portion 71*a* of the driven roller holder 71. As shown in FIG. 7A, when the motor rotates backward in this state, and the driving shaft gear 31 performs the CW rotation when seen from the front side, the outer ring 41*a* and the sun gear 41*b* of the three consecutive planetary gear train 41 perform the CCW rotation when seen from the front side, and the first planetary gear 41*c* to the third planetary gear 41*e* perform the CW rotation when seen from the front side. Furthermore, the connection member 41*f* is pressed in the CCW direction when seen from the front side by means of the CW rotation of the sun gear 41*b*, so that the first planetary gear 41*c* to the third planetary gear 41*e* rotate integrally in the CW direction when seen from the front side.

Then, the first planetary gear 41*c* is separated from the second feeding roller gear 32*a*2, and the rotations of the second feeding roller gear 32*a*2 and the first feeding roller gear 32*a*1 stop. The feeding roller 2 hereby stops. Furthermore, the connection of the second planetary gear 41*d* with the first half turn gear 75*a* of the complex gear 75 is released and they enter the separated state.

Furthermore, as shown in FIG. 7A, the third gear 41*e* is engaged and connected with the second half-turn gear 75*b* situated on the right half when seen from the bottom side of the complex gear 75. Then, the driving force of the motor is transmitted from the third planetary gear 41*e* to the second half-turn gear 75*b*, so that the complex gear 75 performs the CCW rotation when seen from the front side. Then, the driving force is transmitted to eccentric cam gear 74, which is engaged and connected with the cam driving gear 75*c* of the complex gear 75, the eccentric cam gear 74 performs the CW rotation when seen from the front side, and the eccentric cam 72 performs the CW rotation when seen from the front side.

When the complex gear 75 rotates by about 180° in the CCW rotation direction when seen from the front side from the state shown in FIG. 7A, as shown in FIG. 7B, the second half-turn gear 75*b* enters the state of being situated on the left half when seen from the bottom side of the complex gear 75. Then, the engagement of the second half-turn gear 75*b* with the third planetary gear 41*e* is disengaged and the rotation of the complex gear 75 stops. As a result, the eccentric cam 72 stops in the state in which the long diameter portion 72*b* is in contact with the contact portion 71*a* of the driven roller holder 71. The driven roller holder 71 moves from the position shown in FIG. 7A to the position shown in FIG. 7B by means of the rotation of the eccentric cam 72, and the driven roller 6 is disposed at the open position separated from the feeding roller 2.

As a result, as shown in FIG. 2, the recording paper P is wound around the roll R by the CW rotation of the support shaft 1 in the state of not being pinched by the driven roller 6 and the feeding roller 2. At this time, the second high resistance torque limiter 52*d* is connected to the support shaft 1 via the low resistance torque limiter gear 33*b*1 and the planetary gear 52*b* of the second torque limiter planetary gear train 52. Thus, it is possible to give the relatively high rotation resistance of, for example, about 1 kgf·cm with respect to the support shaft 1 when the recording paper P is wound. Thus, it is possible to wind the recording paper P, while preventing the revolution due to inertia of the support shaft 1.

Figure 3:
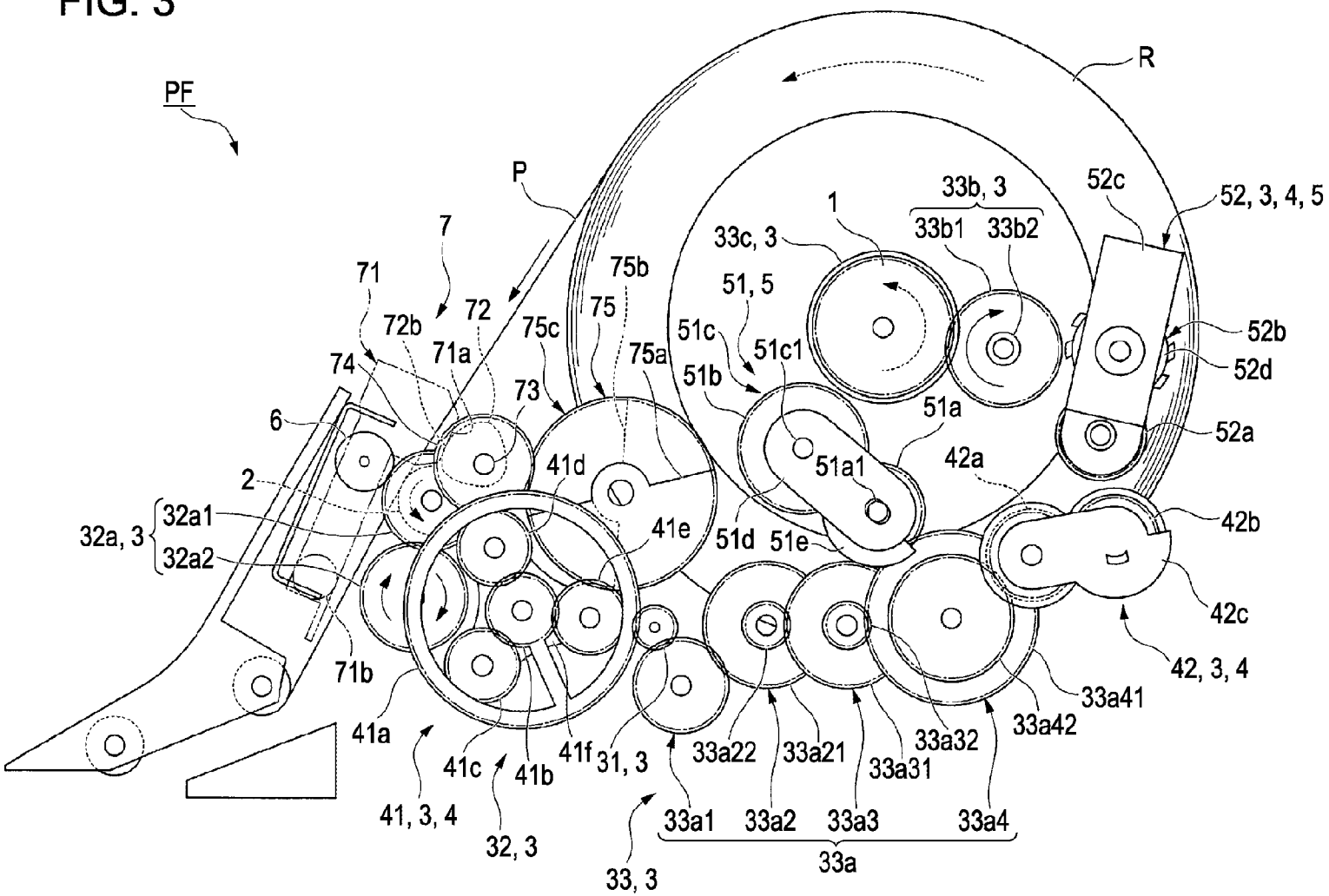
FIG. 3 is a side view in a low torque printing sate of the paper feeding device in FIG. 1.

Next, the paper feeding device PF in the low tension printing state shown in FIG. 3 will be described.

In order to transform the paper feeding device PF to the low tension state, for example, the motor is rotated backward, and passes through the winding state shown in FIG. 2, and then the motor is stopped. Then, as shown in FIG. 3, the first gear 33*a*1 to the fourth gear 33*a*4 of the driving shaft gear 31 and the driving force transmission gear 33*a* stop, and the sun gear 51*a* of the first torque limiter planetary gear train 51 and the sun gear 42*a* of the connection planetary gear train 42, which are connected with the fourth gear 33*a*4, enter the stop state.

Since the first torque limiter planetary gear train 51 is disposed so as to be sloped in the CCW rotation direction with respect to the vertical direction within the rotatable range, the gravity acts in the CCW direction. For that reason, the first torque limiter planetary gear train 51 maintains the open state in which the support shaft gear 33*c* is separated from the planetary gear 51*b* as shown in FIG. 3 without rotating from the state shown in FIG. 2 in the CW direction, even when the sun gear 51*a* stops and the pressing force to the connection member 51*f* in the CW direction is eliminated, in the winding state shown in FIG. 2.

Since the connection planetary gear train 42 is disposed so as to be sloped in the CW rotation direction with respect to the vertical direction within the rotatable range, the gravity acts on the holder 42*c* in the CW direction. For that reason, when the sun gear 42*a* stops and the pressing force to the holder 42*c* in the CCW direction is eliminated in the winding state shown in FIG. 2, the connection planetary gear train 42 rotates in the CW direction by means of the gravity in the CW direction acting on the holder 42*c*. Then, as shown in FIG. 3, the engagement of the planetary gear 42*b* of the connection planetary gear train 42 with the sun gear 52*a* of the second torque limiter planetary gear train 52 is disengaged and the connection is released, whereby the transmission of the driving force is cut therebetween. As a result, the sun gear 52*a* of the second torque limiter planetary gear train 52 stops.

Since the second torque limiter planetary gear train 52 is disposed so as to be sloped in the CW rotation direction with respect to the vertical direction within the rotatable range, the gravity acts on the holder 52*c* in the CW direction. For that reason, when the sun gear 52*a* stops and the pressing force to the holder 52*c* in the CCW direction is eliminated in the winding state shown in FIG. 2, the second torque limiter planetary gear train 52 rotates in the CW direction by means of the gravity in the CW direction acting on the holder 52*c*. Then, as shown in FIG. 3, the engagement of the planetary gear 52*b* of the second torque limiter planetary gear train 52 and the low resistance torque limiter gear 33*b*1 is disengaged and the connection is released.

As a result, the rotation resistance due to the second high resistance torque limiter 52*d* of the second torque limiter planetary gear train 52 is not transmitted to the support shaft 1 via the low resistance torque limiter gear 33*b*1.

Thus, the support shaft 1 enters the open state in which the rotation resistance is not given from the first high resistance torque limiter 51*c* and the second high resistance torque limiter 52*d* of the rotation resistance switching unit 5 and enters the state in which only the rotation resistance of the low resistance torque limiter 33*b*2 is given.

Furthermore, after passing through the winding state shown in FIG. 2, when the motor is stopped, the driving shaft gear 31 stops, and the outer ring 41*a* and the sun gear 41*b* of the three consecutive planetary gear train 41 stop. Then, as shown in FIG. 3, the state, in which the complex gear 75 and the eccentric cam gear 74 stop, is maintained, and the driven roller 71 is maintained in the state in which the contact portion 71*a* is in contact with the long diameter portion 72*b* of the eccentric cam 72. As a result, the driven roller 6 is disposed at the open position and the recording paper P is maintained in the state of not being pinched by the driven roller 6 and the feeding roller 2.

When the recording P is transported by means of a printing device (not shown) disposed on the downstream side in the feeding direction of the recording paper P of the paper feeding device PF in this state, the tension acts on the recording paper P, the tension of the recording paper P acts on the outer periphery of the roll R, and the torque acts on the support shaft 1 that supports the roll R. Then, as shown in FIG. 3, the support shaft 1 performs the CCW rotation, the recording paper P is pulled out from the roll R, and the recording paper P is fed from the paper feeding device PF to the printing device (not shown). At this time, for example, the relatively small rotation resistance of about 300 gf·cm due to the low resistance torque limiter 33*b*2 is given to the support shaft 1 via the low resistance torque limiter gear 33*b*1 and the support shaft gear 33*c*. Thus, the paper feeding device PF can give the recording paper P the relatively small tension in the low tension printing state shown in FIG. 3.

Next, the paper feeding device PF of a high tension printing state shown in FIG. 4 will be described.

Figure 4:
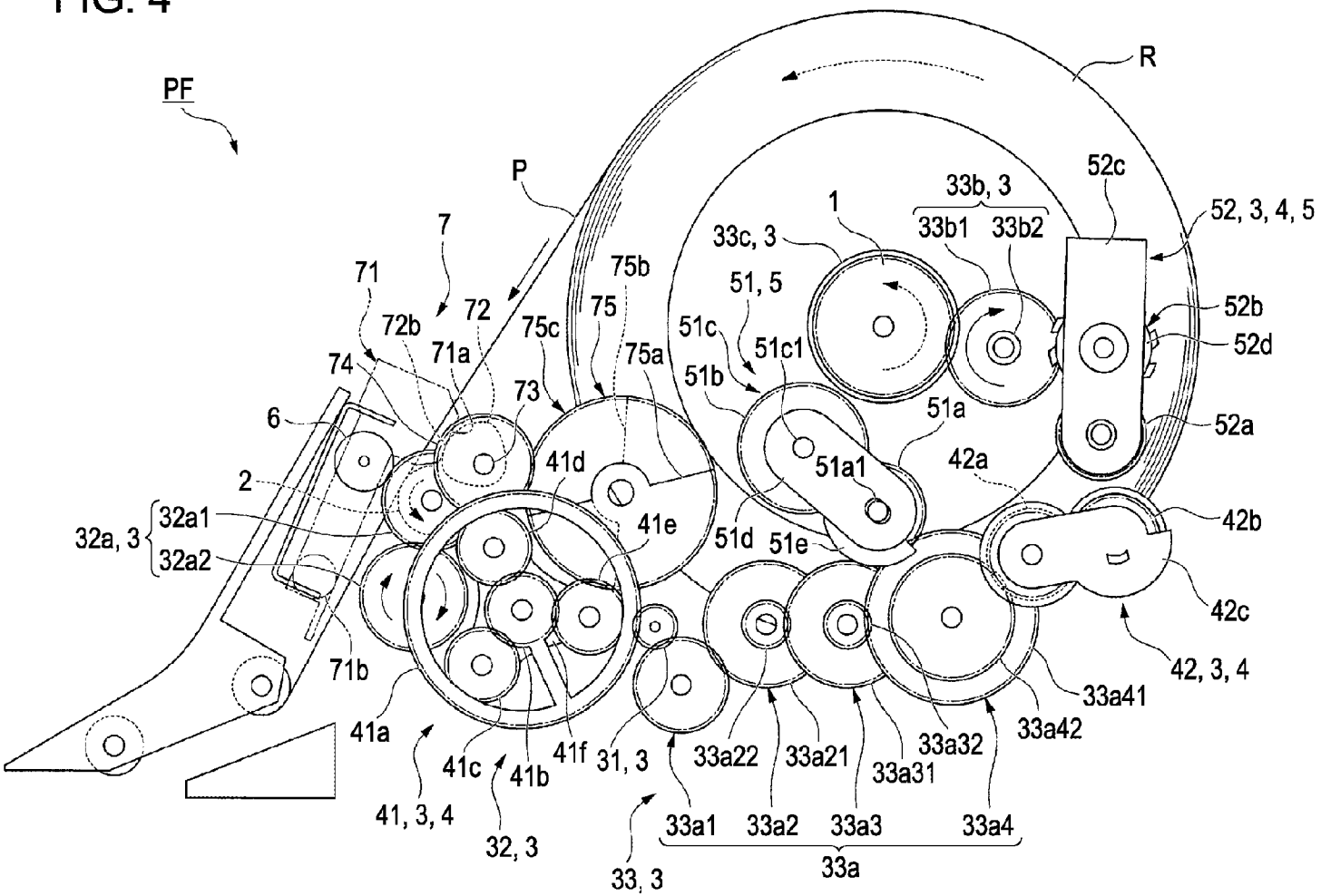
FIG. 4 is a side view in a high torque printing sate of the paper feeding device in FIG. 1.

The transition of the paper feeding device PF to the high tension printing state shown in FIG. 4 can be performed in substantially the same order as the above-mentioned transition to the low tension printing state. The transition to the high tension printing state is different from the above-mentioned transition to the low tension printing state in that, before the motor is stopped in the winding state shown FIG. 2, the lock mechanism of the second torque limiter planetary gear train 52 is operated. Otherwise, the transition to the high tension printing state is the same as the transition to the low tension printing state, thus the description of the same portions will be omitted.

In order to transform the paper feeding device PF to the high tension printing state shown in FIG. 4, the lock mechanism of the second torque limiter planetary gear train 52 is operated in the winding state shown in FIG. 2, and then the motor is stopped. Then, as shown in FIG. 4, the driving shaft gear 31 and the first gear 33*a*1 to the fourth gear 33*a*4 of the driving force transmission gear train 33*a* stop, and the sun gear 51*a* of the first torque limiter planetary gear train 51 and the sun gear 42*a* of the connection planetary gear train 42, which are connected to the fourth gear 33*a*4, stop.

Then, the first torque limiter planetary gear train 51 maintains the open state in which the support shaft gear 33*c* is separated from the planetary gear 51*b* in the same manner as the transition to the low tension printing state. Furthermore, in the same manner as the transition to the low tension printing state, the connection planetary gear train 42 also rotates in the CW direction due to the gravity in the CW direction acting on the holder 42*c*. In addition, as shown in FIG. 4, the engagement of the planetary gear 42*b* of the connection planetary gear train 42 with the sun gear 52*a* of the second torque limiter planetary gear train 52 is disengaged and the connection is released. As a result, the sun gear 52*a* of the second torque limiter planetary gear train 52 stops.

Herein, since the lock mechanism acts and the holder 52*c* is fixed, the second torque limiter planetary gear train 52 maintains the state in which the planetary gear 52*b* and the low resistance torque limiter gear 33*b*1 are engaged and connected with each other, without rotating in the CW direction even when the gravity acts on the holder 52*c* in the CW direction.

As a result, the rotation resistance due to the second high resistance torque limiter 52*d* of the second torque limiter planetary gear train 52 is transmitted to the support shaft 1 via the low resistance torque limiter gear 33*b*1.

Thus, the support shaft 1 enters the limitation state in which the rotation resistance is given from the second high resistance torque limiter 52*d* of the second torque limiter planetary gear train 52 constituting the rotation resistance switching unit 5. Herein, the rotation resistance of the low resistance torque limiter 33*b*2 is given to the support shaft 1 via the low resistance torque limiter gear 33*b*1 and the support shaft gear 33*c*. However, on the support shaft 1, the influence of the second high resistance torque limiter 52*d*, which gives larger rotation resistance, becomes dominant.

Furthermore, after passing through the winding state shown in FIG. 2, when the motor is stopped, in the same manner as the transition to the low tension printing state, the driven roller holder 71 is maintained in the state in which the contact portion 71*a* is in contact with the long diameter portion 72*b* of the eccentric cam 72. As a result, the driven roller 6 is disposed at the open position and the recording paper P is maintained in the state of not being pinched by the driven roller 6 and the feeding roller 2.

In this state, when a printing device (not shown) disposed on the downstream side in the feeding direction of the recording paper P of the paper feeding device PF transports the recording paper P, the tension acts on the recording paper P, the tension of the recording paper P acts on the outer periphery of the roll R, and the torque acts on the support shaft 1 that supports the roll R. Then, as shown in FIG. 4, the support shaft 1 performs the CCW rotation, the recording paper P is pulled out from the roll R, and the recording paper P is fed from the paper feeding device PF to the printing device (not shown). At this time, the relatively large rotation resistance of, for example, about 1 kgf·cm due to the second high resistance torque limiter 52*d* is given to the support shaft 1 via the planetary gear 52*b* of the second torque limiter planetary gear train 52, the low resistance torque limiter gear 33*b*1, and the support shaft gear 33*c*. Thus, in the high tension printing state shown in FIG. 4, the paper feeding device PF can give the recording paper P the tension greater than that of the low tension printing state.

As described above, according to the paper feeding device PF of the present embodiment, it is possible to give a suitable rotation resistance depending on a change in situation with respect to the support shaft 1 for supporting the roll R of the recording paper P, which can automate the switch of the rotation resistance given to the support shaft 1.

Furthermore, as the driving force switching unit 4, by including the connection planetary gear train 42 in which the slope angle from the vertical direction is larger than the second torque limiter planetary gear train 52 and the rotation speed at the time of cutting the driving force is higher than the second torque limiter planetary gear train 52, it is possible to rapidly perform the cutting of the driving force of the motor to the support shaft.

In addition, the present invention is not limited to the above-mentioned embodiment but various alterations can be made with the scope without departing from the gist of the present invention. For example, the first torque limiter planetary gear train may not be provided rotatably around the rotation shaft of the sun gear. In this case, it is possible to make a configuration in which the planetary gear of the first torque limiter planetary gear train is always connected with the support shaft gear. With this configuration, it is possible to reduce the number of the components of the paper feeding device, simplify the manufacturing processes and decrease the manufacturing costs.

Furthermore, the second torque limiter may be a one-way torque limiter which limits some rotation torque of the CW rotation and the CCW rotation of the planetary gear (the rotation gear) of the second torque limiter planetary gear train. In this case, it is possible to prevent the idling due to the inertia of the support shaft by controlling the current of the motor.

Moreover, although the description has been given of the case of the transition to the printing state after passing through the winding state in the paper feeding device in the above-mentioned embodiment, the feeding device may be transformed from the paper feeding state to the direct printing state.

Furthermore, the pressing force of the pressing member of the first torque limiter planetary gear train may be smaller than the rotation force in the CCW direction due to the gravity which acts on the first torque limiter planetary gear train during stop of the rotation of the sun gear. In this case, it is possible to release the connection of the first high resistance torque limiter with the support shaft by stopping the motor after passing through the paper feeding state in the paper feeding device.

That is, in the case of transforming from the paper feeding state to the direct printing state, it is possible to adjust the rotation resistance acting on the support shaft by adjusting the pressing force of the pressing member of the first torque limiter planetary gear train.

What is claimed is:

1. A recording medium feeding device for feeding a recording medium, which is wound in the shape of a roll and is supported by a support shaft, by means of a feeding roller comprising:

a motor for generating a driving force;

a driving force transmission unit for rotating the support shaft by transmitting the driving force; and a rotation resistance switching unit which can switch a limitation state of giving the support shaft a rotation resistance and an open state of not giving the support shaft the rotation resistance, wherein the rotation resistance switching unit includes a torque limiter being rotatable around the rotation shaft, and enters the limitation state by being fixed and enters the open state by being opened a torque limiter fixing unit being connected with the driving force transmission unit, and fix the torque limiter by a rotation of the motor in a first direction and open the torque limiter by a rotation of the motor in a second direction opposite to the first direction, wherein the torque limiter fixing unit includes a holder being movable in a third direction parallel to a longitudinal direction of the rotation shaft and fixing the torque limiter by being changed in position in the third direction.

2. The recording medium feeding device according to claim 1, wherein the torque limiter fixing unit include a cam having a support surface to support the holder, the support surface being sloped with respect to a plane perpendicular to the longitudinal direction of the rotation shaft.

3. The recording medium feeding device according to claim 2, wherein the torque limiter fixing unit includes a sliding gear, which is connected to the driving force transmission unit to transmit the driving force being rotatable around a rotation shaft parallel to the rotation shaft of the torque limiter, and wherein the cam being slidable with the sliding gear rotatable around the rotation shaft of the sliding gear.

4. The recording medium feeding device according to claim 3, wherein a first support portion for supporting the holder in a state of being fitted to the torque limiter and a second support portion for supporting the holder in a state of not being fitted to the torque limiter are provided on the support surface, and wherein the cam rotates so as to bring the first support portion into contact with the holder by the rotation in the first direction of the motor and bring the second support portion into contact with the holder by the rotation in the second direction of the motor.

5. The recording medium feeding device according to claim 2, wherein a first support portion for supporting the holder in a state of being fitted to the torque limiter and a second support portion for supporting the holder in a state of not being fitted to the torque limiter are provided on the support surface, and wherein the cam rotates so as to bring the first support portion into contact with the holder by the rotation in the first direction of the motor and bring the second support portion into contact with the holder by the rotation in the second direction of the motor.

6. The recording medium feeding device according to claim 1, wherein the rotation resistance switching unit includes a torque limiter rotation unit which rotates so as to connect the torque limiter with the support shaft by the rotation in the first direction of the motor and release the connection of the torque limiter with the support shaft by the stopping of the motor or the rotation in the second direction of the motor.

7. The recording medium feeding device according to claim 1, wherein the driving force transmission unit is provided to transmit the driving force so as to rotate the feeding roller or the support shaft, wherein the driving force transmission unit includes a driving force switching unit which can switch the transmission of the driving force to the feeding roller or the support shaft due to the driving force transmission unit, and wherein the driving force switching unit is provided so as to transmit the driving force to the feeding roller via the driving force transmission unit by the rotation in the first direction of the motor and transmit the driving force to the support shaft via the driving force transmission unit by the rotation in the second direction of the motor.

8. The recording medium feeding device according to claim 7, wherein the driving force switching unit includes a rotation gear train having a center gear, which is connected to the driving force transmission unit, and a rotation gear which is connected with the center gear and is provided rotatably around a rotation shaft of the center gear, and wherein the rotation gear train rotates so as to release the connection of the rotation gear with the support shaft by means of the stopping or the rotation in the first direction of the motor and connect the rotation gear with the support shaft by means of the rotation in the second direction of the motor.

9. The recording medium feeding device according to claim 7, wherein the driving force switching unit includes an outer ring, which is engaged with a driving shaft gear provided on the driving shaft of the motor, a sun gear which is disposed on a rotation center of the outer ring and is connected so as to be integrally rotatable with the outer ring, and a planetary gear train having a plurality of planetary gears which is disposed around the sun gear inside the outer ring, is engaged with the sun gear and is connected so as to be integrally rotatable in the rotation direction of the sun gear, and wherein the planetary gear train is provided such that the plurality of planetary gears rotates by means of the rotation in the first direction of the motor, whereby a first planetary gear among the plurality of planetary gears is engaged with a feeding roller gear, which transmits the driving force to the feeding roller in the driving force transmission unit, and the plurality of planetary gears rotates by means of the rotation in the second direction of the motor, whereby the engagement of the first planetary gear with the feeding roller gear is disengaged.

10. The recording medium feeding device according to claim 9 further comprising:

a driven roller for pinching the recording medium together with the feeding roller; and a driven roller moving unit which is driven by the planetary gear train to move the driven roller to a pinch position near the feeding roller or to an open position separated from the feeding roller, wherein the driven roller moving unit includes a driven roller holder which rotatably supports the driven roller, an eccentric cam which moves the driven roller to the pinch position and the open position by moving the driven roller holder, an eccentric cam gear provided on a rotation shaft of the eccentric cam, and a complex gear in which a cam driving gear engaged with the eccentric cam gear is provided between a first partial gear and a second partial gear which are respectively provided at different angle ranges, and wherein the planetary gear train is provided such that the plurality of planetary gears rotates by the rotation in the first direction of the motor, whereby a second planetary gear among the plurality of planetary gears is engaged with the first partial gear, and the plurality of planetary gears rotates by the rotation in the second direction of the motor, whereby a third planetary gear among the plurality of planetary gears is engaged with the second partial gear.

11. The recording medium feeding device according to claim 1 further comprising:

a fixing torque limiter gear train which is always connected to the support shaft to give the support shaft a rotation resistance, wherein the rotation resistance given by the fixing torque limiter gear train is smaller than that given by the rotation resistance switching unit.

* * * * *